US007280782B2

(12) United States Patent
Maeda et al.

(10) Patent No.: US 7,280,782 B2
(45) Date of Patent: Oct. 9, 2007

(54) IMAGE FORMING APPARATUS WITH A DOCUMENT IDENTICAL SIZE MODE AND OUTPUTTING A DOCUMENT IMAGE HAVING A SIZE CONFORMING TO THE DOCUMENT

(75) Inventors: Tetsuya Maeda, Osaka (JP); Yasuhiko Kida, Osaka (JP); Hiromi Sakata, Osaka (JP)

(73) Assignee: Kyocera Mita Corporation (JP)

( * ) Notice: Subject to any disclaimer, the term of this patent is extended or adjusted under 35 U.S.C. 154(b) by 183 days.

(21) Appl. No.: 11/191,288

(22) Filed: Jul. 28, 2005

(65) Prior Publication Data

US 2007/0025752 A1 Feb. 1, 2007

(51) Int. Cl.
*G03G 15/00* (2006.01)

(52) U.S. Cl. ..... 399/81; 399/82

(58) Field of Classification Search ..... 399/81, 399/82, 85, 86, 370, 376; 715/771
See application file for complete search history.

(56) References Cited

U.S. PATENT DOCUMENTS 6,097,852 A * 8/2000 Yamamoto ..... 382/282
6,118,972 A * 9/2000 Yamazaki et al. ..... 399/82 X
6,285,842 B1 * 9/2001 Katamoto et al. ..... 399/81
6,356,719 B1 * 3/2002 Yoshiura ..... 399/81 X
6,621,992 B2 * 9/2003 Kishi et al. ..... 399/81

FOREIGN PATENT DOCUMENTS

JP 1-161265 6/1989
JP 03-085558 A * 4/1991

* cited by examiner

*Primary Examiner*—Sophia S. Chen
(74) *Attorney, Agent, or Firm*—Gerald E. Hespos; Anthony J. Casella

(57) ABSTRACT

An image forming apparatus is provided with a document size detecting section 24 for detecting the size of a document to be read, a document size changing section 23 for changing the size of a document image based on a magnification set by a user, and a mode setting section 21 for setting an operation mode to a document identical size mode, in which the document image is outputted on a recording sheet having the same size as the one detected by the document size detecting section 24 regardless of the magnification set by the user.

18 Claims, 22 Drawing Sheets

IMAGE FORMING APPARATUS WITH A DOCUMENT IDENTICAL SIZE MODE AND OUTPUTTING A DOCUMENT IMAGE HAVING A SIZE CONFORMING TO THE DOCUMENT

BACKGROUND OF THE INVENTION AND RELATED TO ART STATEMENT

1. Field of the Invention

The present invention relates to an image forming apparatus such as a copier.

2. Description of the Related Art

Image forming apparatuses such as copiers have conventionally had a usage pattern in which a document to be read is copied on a recording sheet of the same size as the document regardless of a set magnification. Further, Japanese Unexamined Patent Publication No. H01-161265 discloses a technology of automatically selecting a recording sheet of an optimal size in conformity with a set magnification as the one on which an image is to be outputted.

However, since the recording sheet of the optimal size in conformity with the set magnification is automatically set as a recording sheet for the image output according to the technology of the above publication, a user has been required to set the size of the recording sheet for the image output if it is desired to print an image of a document on a recording sheet of the same size as the document to be read. Thus, there has been a problem of a large operation load on the user.

SUMMARY OF THE INVENTION

An object of the present invention is to provide an image forming apparatus which can print an image of a document on a recording sheet of the same size as the document without burdening a user with an operation of setting the size of a recording sheet for image output.

The present invention is directed to an image forming apparatus, comprising an image acquiring unit for reading an image of a document to thereby acquire a document image, and a mode setting section for setting an operation mode to a document identical size mode in which the document image is outputted on a recording sheet having the same size as the document regardless of a magnification set by the user.

With this construction, the document image can be printed on the recording sheet having the same size as the document even if the magnification is set by the user and the size of the document image is changed since the document identical size mode is provided in which the document image is printed on the recording sheet having the same size as the one detected by a size detecting section regardless of the magnification set by the user. Thus, the user can print the document image on the recording sheet having the same size as the document even without setting the size of the recording sheet for image output.

BRIEF DESCRIPTION OF THE DRAWINGS OF THE INVENTION

DETAILED DESCRIPTION OF THE PREFERRED EMBODIMENTS OF THE INVENTION

The invention is now described, by way of examples, with reference to the accompanying drawings.

First Embodiment

Figure 1:
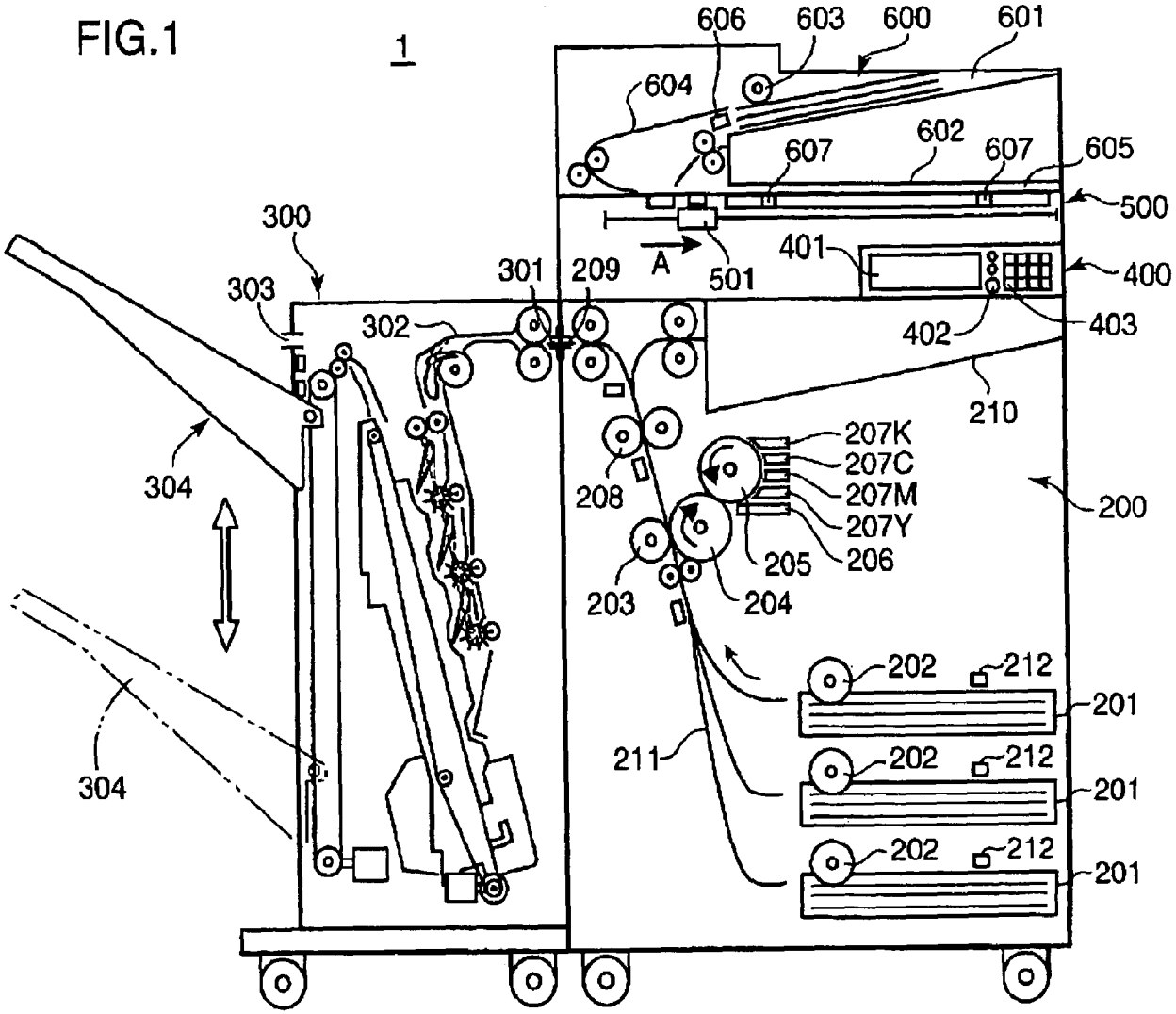
FIG. 1 is a schematic side view mainly showing a mechanical construction of an image forming apparatus according to a first embodiment of the invention.

Hereinafter, embodiments of the present invention are described with reference to the accompanying drawings. FIG. 1 is a schematic side view mainly showing a mechanical construction of an image forming apparatus 1 according to a first embodiment of the invention. This image forming apparatus 1 is comprised of a main unit 200, a sheet post-processing unit 300 arranged at the left side of the main unit 200, an operation unit 400 usable by a user to input various operation commands and the like, a document reading assembly 500 arranged above the main unit 200, and a document conveying assembly 600 arranged above the document reading assembly 500.

The operation unit 400 includes an operation panel 401, a start key 402, a numerical keypad 403, etc. The operation panel 401 displays various operation screens and various operation buttons usable by the user to input various operation commands. The start key 402 is used by the user to input a print execution command and the like, and the numerical keypad 403 is used to input the number of print sets to be made or the like.

The document conveying assembly 600 includes a document placing portion 601, a document discharging portion 602, a sheet discharging roller 603, a document conveying portion 604, a contact glass 605, document detecting sensors 606, 607, etc. The document reading assembly 500 includes a scanner 501 and the like. The sheet discharging roller 603 discharges the documents set on the document placing portion 602, and the document conveying portion 604 conveys the discharged documents one by one onto the scanner 501.

The scanner 501 successively reads the documents being fed, and the read documents are discharged onto the document discharging portion 602. In the case of reading a document placed on the contact glass 605, the scanner 501 slides in A-direction to read the document. A plurality of document detecting sensors 606 are arranged at specified intervals along the width direction of the recording sheet (direction normal to the plane of FIG. 1), and a plurality of document detecting sensors 607 are arranged at the underside of the contact glass 605.

The main unit 200 is provided with a plurality of sheet cassettes 201, a plurality of feed rollers 202, a transfer roller 203, an intermediate transfer roller 204, a photosensitive drum 205, an exposing device 206, developing devices 207Y, 207M, 207C, 207K for the respective colors of yellow, magenta, cyan and black, a fixing roller 208, a discharge opening 209, a discharge tray 210, a recording-sheet conveying portion 211, remaining sheet sensors 212, etc. In the first embodiment, the sheet cassettes 201 contain recording sheets of different sizes. Each remaining sheet sensor 212 is arranged at the corresponding sheet cassette 201 to detect whether there is any recording sheet in the sheet cassette 201 (detect a paper-out condition).

The photosensitive drum 205 is uniformly charged by a charging device (not shown) while being rotated in a direction of an arrow. The exposing device 206 outputs a laser beam converted from a modulated signal generated based on an image data of the document read by the document reading assembly 500, and forms separate electrostatic latent images of the respective colors on the photosensitive drum 205. The developing devices 207Y, 207M, 207C and 207K supply developers of the respective colors to the photosensitive drum 205 to form separate toner images of the respective colors.

The intermediate transfer roller 204 have the toner images of the respective colors transferred thereto from the photosensitive drum 205, whereby a color toner image is formed on the intermediate transfer roller 204.

On the other hand, each feed roller 202 dispenses the recording sheet from the corresponding sheet cassette 210 containing the recording sheets, and the recording-sheet conveying portion 211 conveys the dispensed recording sheet to the transfer roller 203. The transfer roller 203 transfers the toner image on the intermediate transfer roller 204 to the conveyed recording sheet. The recording sheet having the toner image transferred thereto is conveyed by the recording-sheet conveying portion 211 to the fixing roller 208, which heats the transferred toner image to fix it to the recording sheet. Thereafter, the recording sheet is conveyed to the discharge opening 209 by the recording-sheet conveying portion 211 and carried into the sheet post-processing assembly 300. The recording sheet is discharged onto the discharge tray 210 if necessary.

The sheet post-processing assembly 300 is provided with a carry-in opening 301, a recording-sheet conveying portion 302, a carry-out opening 303, a stack tray 304, etc. The recording-sheet conveying portion 302 successively conveys the recording sheets carried through the carry-in opening 301 from the discharge opening 209, and finally discharges the recording sheets onto the stack tray 304 through the carry-out opening 303. The stack tray 304 is so constructed as to be vertically movable in directions of arrows depending on the number of stacked recording sheets discharged from the discharge opening 303.

Figure 2:
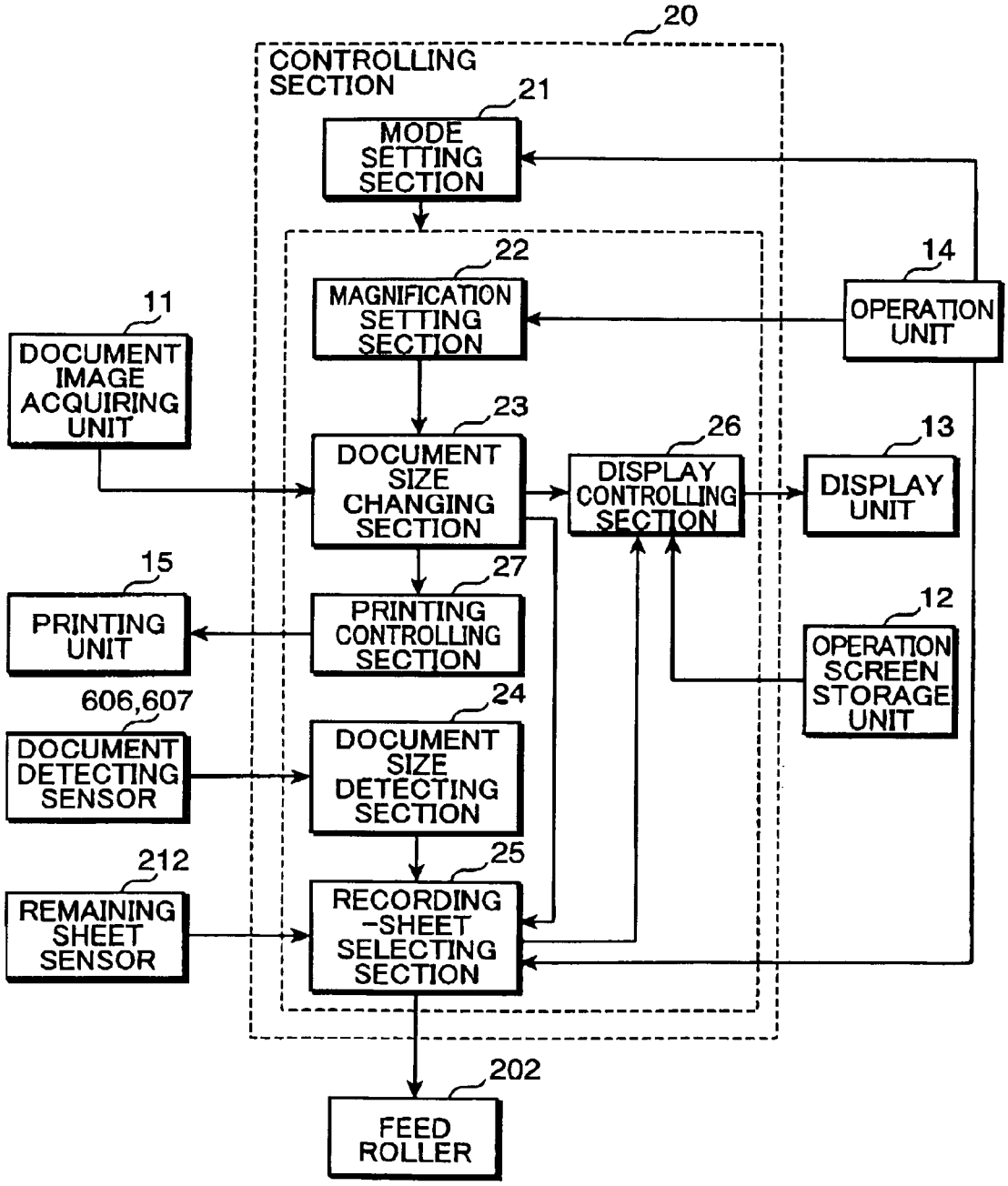
FIG. 2 is a block diagram showing an electrical construction of the image forming apparatus according to the first embodiment.

FIG. 2 is a block diagram showing an electrical construction of the image forming apparatus according to the first embodiment. This image forming apparatus is provided with a document image acquiring unit 11, an operation screen storage unit 12, a display unit 13, an operation unit 14, a printing unit 15 and a control unit 20. The document image acquiring unit 11 is constructed by the document reading assembly 500 shown in FIG. 1 for reading an image of a document placed on the document placing portion 602 or the contact glass 605 to acquire a document image.

The operation screen storage unit 12 stores various operation screens to be displayed on the display unit 13 when a user operates the image forming apparatus. The display unit 13 is constructed by an operation panel 401 shown in FIG. 1. The operation unit 14 is constructed by the operation unit 400 shown in FIG. 1 for receiving an operation command for designating an operation mode of the image forming apparatus, an operation command for designating the magnification of a document image, an operation command for designating the size of a recording sheet on which the document image is to be printed, and other operation commands.

The control unit 20 includes a CPU, a ROM storing a control program, a RAM used as a work area of the CPU and the like, and functions as a mode setting section 21, a magnification setting section 22, a document size changing section 23, a document size detecting section 24, a recording-sheet selecting section 25, a display controlling section 26 and a print controlling section 27 by executing the control program by means of the CPU.

The mode setting section 21 sets the operation mode of the image forming apparatus in accordance with the operation command from the user received by the operation unit 14 to designate the operation mode. In this embodiment, the operation mode is set to any one of an optimal size mode, a document identical size mode, and a manual mode.

The optimal size mode is a mode in which a recording sheet of a suitable size is selected based on the magnification designated by the user and the document image is printed on the selected recording sheet. The document identical size mode is a mode in which the document image is printed on a recording sheet having the same size as the document regardless of the magnification designated by the user. The manual mode is a mode in which the user sets the magnification of the document image and the size of the recording sheet.

The magnification setting section 22 sets the magnification of the document image in accordance with the operation command inputted by the user by means of the operation unit 14 to designate the magnification of the document image. The document size changing section 23 changes the size of the document image acquired by the document image acquiring unit 11 in accordance with the magnification of the document image set by the magnification setting section 22.

In the case that a document to be copied is placed on the document placing portion 601, the document size setting section 24 measures a time starting when the document detecting sensors 606 detect the leading end of the recording sheet and ending when they detect the trailing end of the recording sheet, calculates the length of the document along a conveying direction by multiplying the measured time by a predetermined document conveying speed, and judges to which of standardized lengths such as A3, A4 and B3 the document corresponds based on the calculated length of the document along the conveying direction and a detection pattern of the document detecting sensors 606 having detected the document out of a plurality of document detecting sensors 606 arranged along the width direction of the recording sheet, thereby detecting the size of the document.

In the case that the document is placed on the contact glass 605, the document size detecting section 24 detects the size of the document based on a detection pattern of the document detecting sensors 607 having detecting the document out of a plurality of document detecting sensors 607 arranged at the underside of the contact glass 605.

The recording-sheet selecting section 25 selects the size of the recording sheet on which the document image is to be printed in accordance with the operation mode presently set by the mode setting section 21, and controls the feed roller 202 so as to convey the recording sheet of the selected size. Specifically, the recording-sheet selecting section 25 selects a recording sheet of a size suitable for the document image having the size thereof changed by the document size changing section 23 as a recording sheet to have the document image printed thereon if the optimal size mode is set.

Specifically, a recording sheet of such a size that the document image is printed on the entire surface of the recording sheet while leaving no margin or a recording sheet of such a standardized size as to minimize an area of a margin is selected as the recording sheet to have the document image printed thereon.

The recording-sheet selecting section 25 selects a recording sheet having the same size as the document size detected by the document size detecting section 24 as the recording sheet to have the document image printed thereon if the document identical size mode is set.

The display controlling section 26 causes various operation screens stored in the operation screen storage unit 12 to be displayed on the display unit 13. The printing controlling section 27 controls the printing unit 15 to print the document image having the size thereof changed by the document size changing section 23 on the recording sheet.

Figure 3:
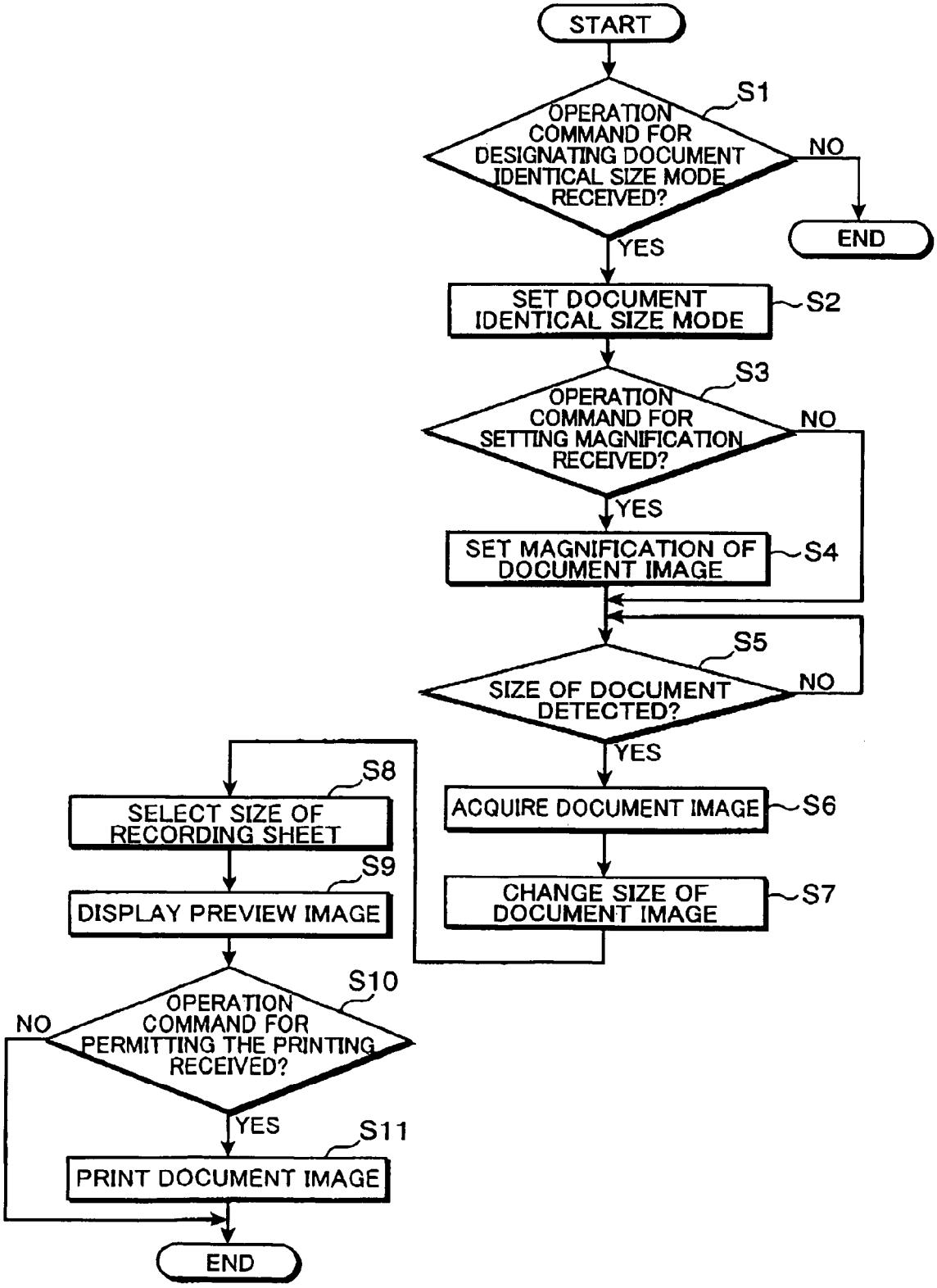
FIG. 3 is a flow chart showing an operation of the image forming apparatus when a user sets the magnification of a document before placing the document on a document placing portion or a contact glass.

FIG. 3 is a flow chart showing the operation of the image forming apparatus when the document identical size mode is set and the user sets the magnification of the document before the size of the document is detected. The operation of the image forming apparatus is described below with reference to the flow chart shown in FIG. 3. It should be noted that the document is placed on the contact glass 605 in the flow chart of FIG. 3. First, if the operation unit 14 receives the operation command for designating the document identical size mode as the operation mode of the image forming apparatus in Step S1 (YES in Step S1), the mode setting section 21 sets the operation mode to the document identical size mode (Step S2). On the other hand, this processing is ended if the operation unit 14 receives an operation command for designating the optimal size mode instead of receiving the operation command for designating the document identical size mode as the operation mode of the image forming apparatus (NO in Step S1).

Figure 4:
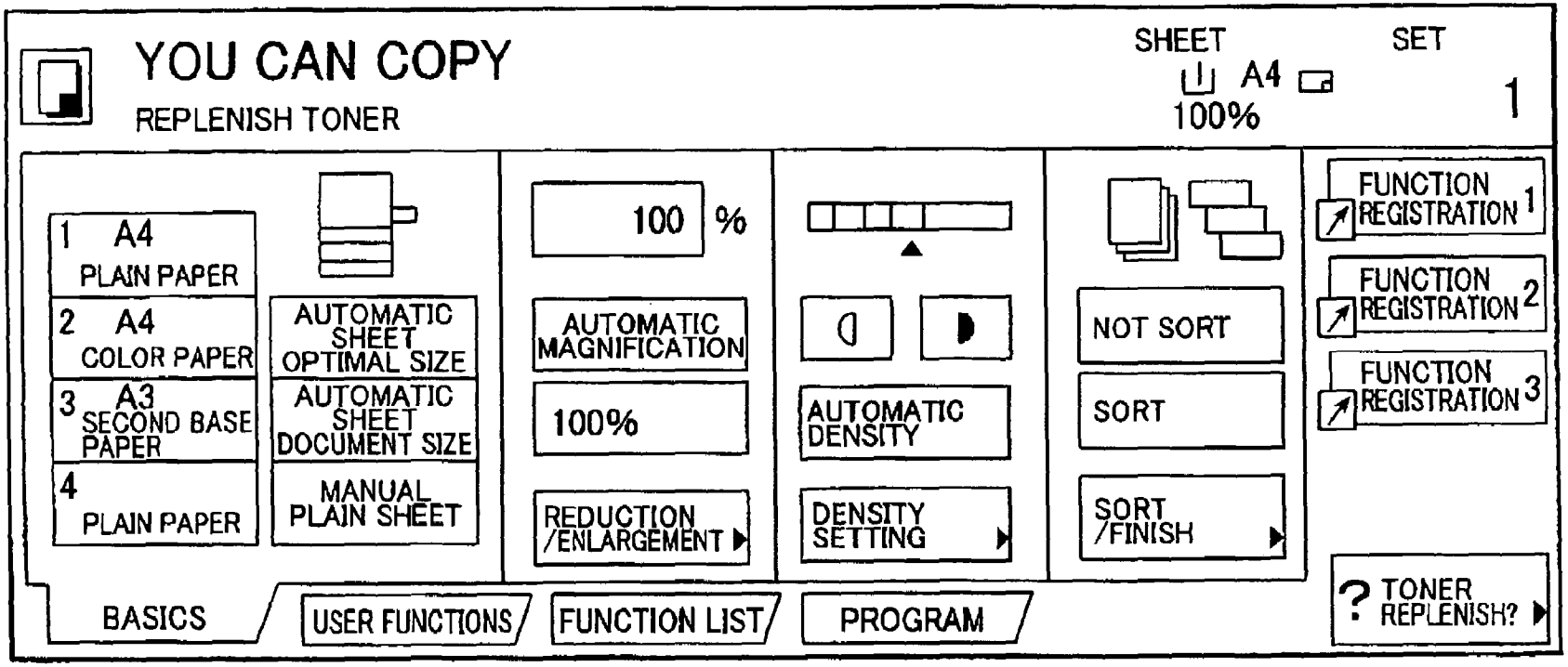
FIG. 4 is a diagram showing an operation screen displayed on a display unit by a display controlling section when the user designates a document identical size mode.

FIG. 4 is a diagram showing one example of the operation screen caused by the display controlling section 26 to be displayed on the display unit 13 when the user designates the document identical size mode. In the second column of the operation screen shown in FIG. 4 from left, buttons written with "Automatic Sheet Optimal Size", "Automatic Sheet Original Size" and "Manual Plain Sheet" are displayed in this order from top. If the user presses the "Automatic Sheet Original Size" button, the mode setting section 21 sets the operation mode to the document identical size mode. If the user presses the "Automatic Sheet Optimal Size", the mode setting section 21 sets the operation mode to the optimal size mode.

If the operation unit 14 receives the operation command from the user for designating the magnification of the document image in Step S3 (YES in Step S3), the magnification setting section 22 sets the magnification indicated by the operation command the operation unit 14 received as the magnification of the document image (Step S4). Unless the operation unit 14 receives the operation command from the user for designating the magnification of the document image (NO in Step S3), this routine proceeds to Step S5. Here, the user inputs a numerical value in the magnification designation box displayed at the top of the third column of the operation screen shown in FIG. 4 from left, using the numerical keypad 403, thereby designating the magnification of the document image.

If a document is placed on the contact glass 605 by the user and the document size detecting section 24 detects the size of the placed document in Step S5 (YES in Step S5), the routine proceeds to Step S6. If no document is placed on the contact glass 605 by the user and, therefore, the document size detecting section 24 does not detect the size of the document (NO in Step S5), this routine returns to Step S5. In Step S6, the document image acquiring unit 11 reads the document placed on the contact glass 605 and acquires a document image.

In Step S7, the document size changing section 23 changes the size of the document image at the magnification set in Step S4. Here, the document size changing section 23 enlarges the document image if a numerical value larger than 100(%) is designated as the magnification by the user, while reducing the document image in size if a numerical value smaller than 100(%) is designated as the magnification.

In Step S8, the recording-sheet selecting section 25 selects the size of a recording sheet on which the document image having the size thereof changed is to be printed. Here, since the document identical size mode is set, the recording-sheet selecting section 25 selects the recording sheet having the same size as the document detected by the document size detecting section 24.

In Step S9, the display controlling section 26 generates a preview image to let the user know about a printed state of the document image having the size thereof changed by the document size changing section 23 on the recording sheet selected by the recording-sheet selecting section 25 before printing, and causes the generated preview image to be displayed on the display unit 13. In the document identical size mode, the document image is printed on the recording sheet having the same size as the document image regardless of the magnification of the document image. Thus, the document image may be too large to be entirely printed within the recording sheet depending on the magnification designated by the user. Accordingly, the user can confirm before printing whether or not some part of the document image cannot be printed within the recording sheet and, if so, which part of the document image cannot be printed on the recording sheet by displaying the preview image on the display unit 13 before printing.

If the operation unit 14 receives the operation command from the user for permitting the printing in Step S10 (YES in Step S10), the recording-sheet selecting section 25 drives the feed roller 202 corresponding to the sheet cassette 201 containing the recording sheets of the selected size to convey the recording sheet to the printing unit 15, and the printing controlling section 27 controls the printing unit 15 such that the document image having the size thereof changed by the document size changing section 23 is printed on the conveyed recording sheet (Step S11). On the other hand, this routine is ended if the operation unit 14 receives such an operation command as not to permit the printing in Step S10 (No in Step S10).

Figure 5:
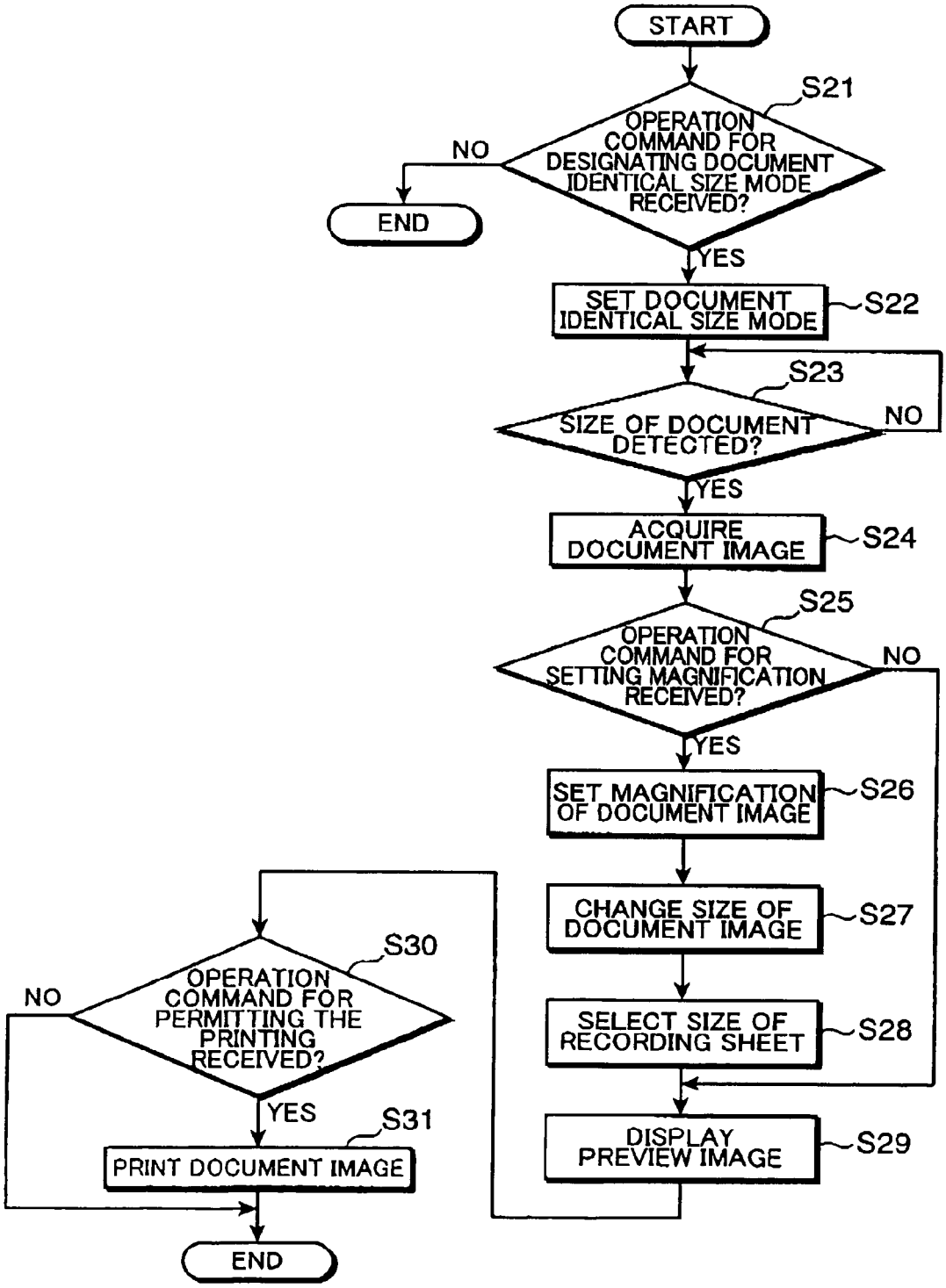
FIG. 5 is a flow chart showing the operation of the image forming apparatus when the user sets the magnification of the document after placing the document on the document placing portion or the contact glass.

Next, the operation of the image forming apparatus is described when the document identical size mode is set and the user sets the magnification of a document after the size of the document is detected. FIG. 5 is a flow chart showing the operation of the image forming apparatus in this case. It should be noted that the document is placed on the contact glass 605 in the flow chart of FIG. 5. First, if the operation unit 14 receives an operation command for designating the document identical size mode as the operation mode of the image forming apparatus in Step S21 (YES in Step S21), the mode setting section 21 sets the operation mode to the document identical size mode (Step S22). On the other hand, this processing is ended if the operation unit 14 receives an operation command for designating the optimal size mode instead of receiving the operation command for designating the document identical size mode as the operation mode of the image forming apparatus (NO in Step S21).

If a document is placed on the contact glass 605 by the user and the document size detecting section 24 detects the size of the placed document in Step S23 (YES in Step S23), the routine proceeds to Step S24. If no document is placed on the contact glass 605 by the user and, therefore, the document size detecting section 24 does not detect the size of the document (NO in Step S23), this routine returns to Step S23. In Step S24, the document image acquiring unit 11 reads the document placed on the contact glass 605 and acquires a document image.

If the operation unit 14 receives an operation command from the user for designating the magnification of the document image in Step S25 (YES in Step S25), the magnification setting section 22 sets the magnification indicated by the operation command the operation unit 14 received as the magnification of the document image (Step S26). This routine proceeds to Step S29 unless the operation unit 14 receives the operation command from the user for designating the magnification of the document image (NO in Step S25). In such a case, the magnification setting section 22 sets the magnification of the document image at 1:1 magnification.

In Step S27, the document size changing section 23 changes the size of the document image at the magnification set in Step S26. In Step S28, the recording-sheet selecting section 25 selects the size of a recording sheet on which the document image having the size thereof changed is to be printed. Here, since the document identical size mode is set, the recording-sheet selecting section 25 selects the recording sheet having the same size as that of the document detected by the document size detecting section 24 as the recording sheet to have the document image printed thereon.

In Step S29, the display controlling section 26 generates a preview image to let the user know about a printed state of the document image having the size thereof changed by the document size changing section 23 on the recording sheet selected by the recording-sheet selecting section 25 before printing, and causes the generated preview image to be displayed on the display unit 13. If the operation unit 14 receives an operation command from the user for permitting the printing in Step S30 (YES in Step S30), the recording-sheet selecting section 25 drives the feed roller 202 corresponding to the sheet cassette 201 containing the recording sheets of the selected size to convey the recording sheet to the printing unit 15, and the printing controlling section 27 controls the printing unit 15 such that the document image having the size thereof changed by the document size changing section 23 is printed on the conveyed recording sheet (Step S31). On the other hand, this routine is ended if the operation unit 14 receives such an operation command as not to permit the printing in Step S30 (No in Step S30).

As described above, since the image forming apparatus of the first embodiment has the document identical size mode, the user can have the document image printed on the recording sheet of the same size as the document even without designating the size of the recording sheet if the operation mode is set to the document identical size mode beforehand.

Further, even if the magnification of the document is set by the user before or after the size of the document is detected when the document identical size mode is set, the document identical size mode is kept without being changed to another operation mode such as the manual mode. Therefore, the document image can be printed on the recording sheet having the same size as the document without designating the size of the recording sheet.

Although the preview image is displayed and the document image is printed on the recording sheet upon receiving the operation command for permitting the printing in the first embodiment, the present invention is not limited thereto. The document image may be printed on the recording sheet without displaying any preview image and without letting the user to input the operation command for permitting the printing. In such a case, the operation burden on the user can be mitigated.

In the fist embodiment, the recording-sheet selecting section 25 may select a recording sheet having a size most approximate to the size of the document as the recording sheet to have the document image printed thereon in the case that the recording sheets of the same size have run out or the sheet cassette containing the recording sheets of the same size is not provided (including a case where the document is not of a standard size). Here, the recording-sheet selecting section 25 receives a detection signal outputted from the remaining sheet sensor 212 to judge based on the level of the received detection signal whether or not the recording sheets have run out. Further, it is preferable to calculate the area of the document and select a recording sheet having a size most approximate to the calculated area. In this case, it is more preferable to select a recording sheet of such a size having a larger area than the area of the document.

Second Embodiment

Figure 6:
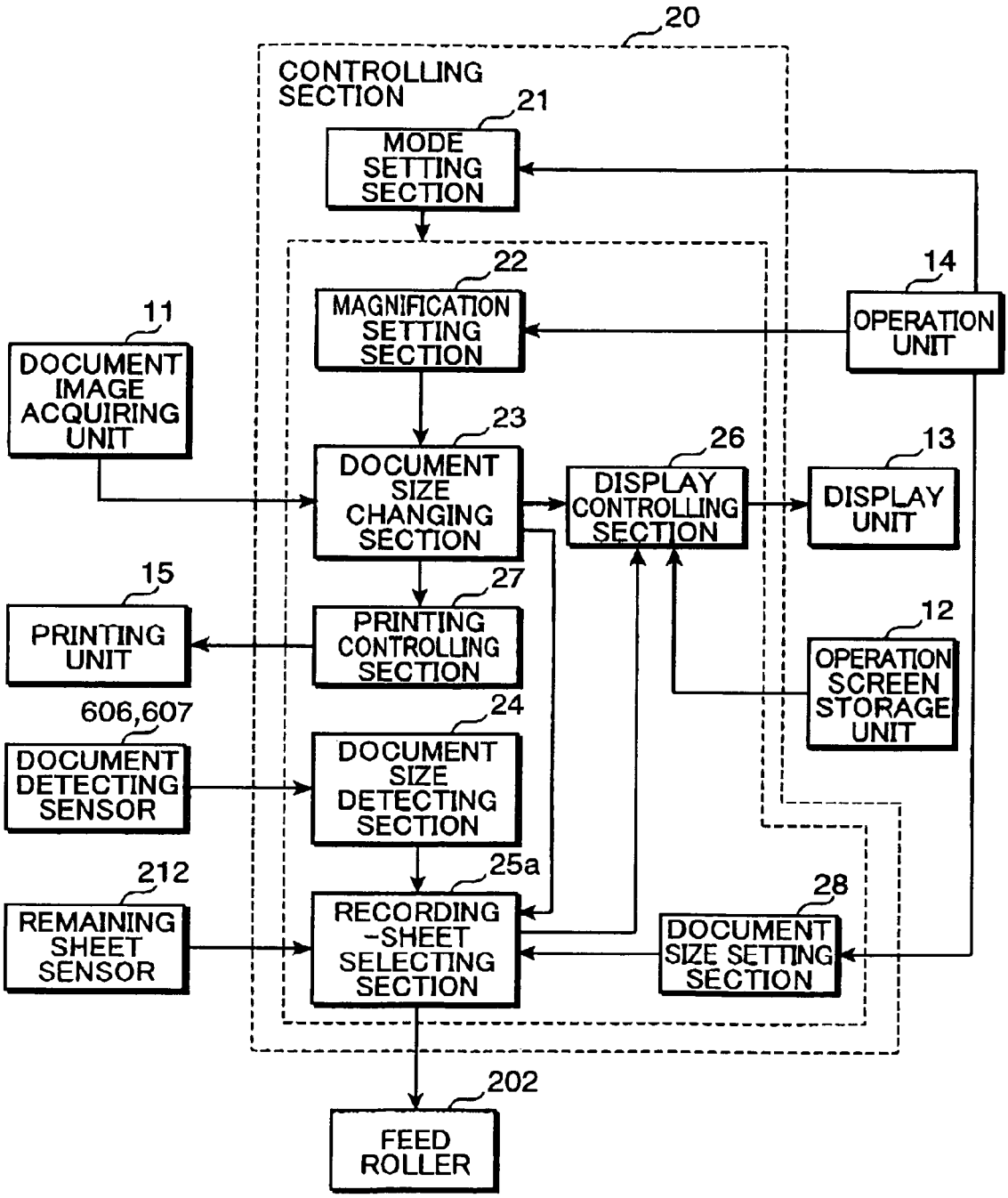
FIG. 6 is a block diagram showing an electrical construction of an image forming apparatus according to a second embodiment of the invention.

FIG. 6 is a block diagram showing an electrical construction of an image forming apparatus according to a second embodiment of the present invention. The same elements as those of the first embodiment are identified by the same reference numerals in FIG. 6 and are not described. The second embodiment is characterized in that the size of a document set by a user is determined as the size of a recording sheet for image output.

A recording-sheet selecting section 25*a* is, in addition to the functions of the recording-sheet selecting section 25 of the first embodiment, provided with a function of selecting a recording sheet having the same size as that of the document detected by the document size detecting section 24 or a recording sheet having the same size as that of the document set by a document size setting section 28 as a recording sheet to have a document image printed thereon if the document identical size mode is set.

The document size setting section 28 sets the size of a document to be read in accordance with an operation command inputted by the user by means of the operation unit 14.

Figure 7:
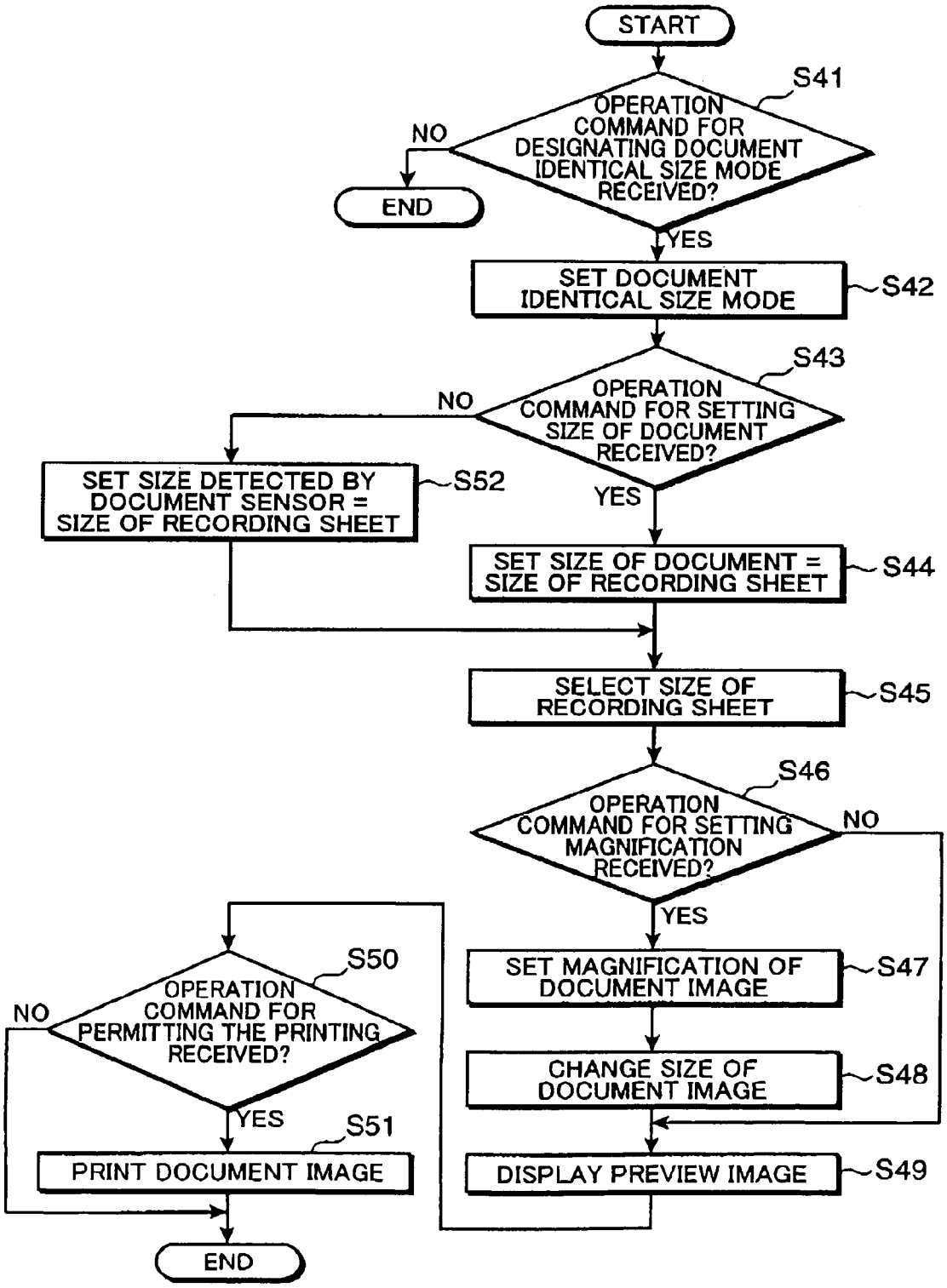
FIG. 7 is a flow chart showing the operation of the image forming apparatus according to the second embodiment.

FIG. 7 is a flow chart showing the operation of the image forming apparatus of the second embodiment when the document identical size mode is set. If the operation unit 14 receives an operation command for designating the operation mode of the image forming apparatus to the document identical size mode in Step S41 (YES in Step S41), the mode setting section 21 sets the operation mode to the document identical size mode (Step S42). On the other hand, this processing is ended if the operation unit 14 receives an operation command for designating the optimal size mode instead of receiving the operation command for designating the document identical size mode as the operation mode of the image forming apparatus (NO in Step S41).

Figure 8A:
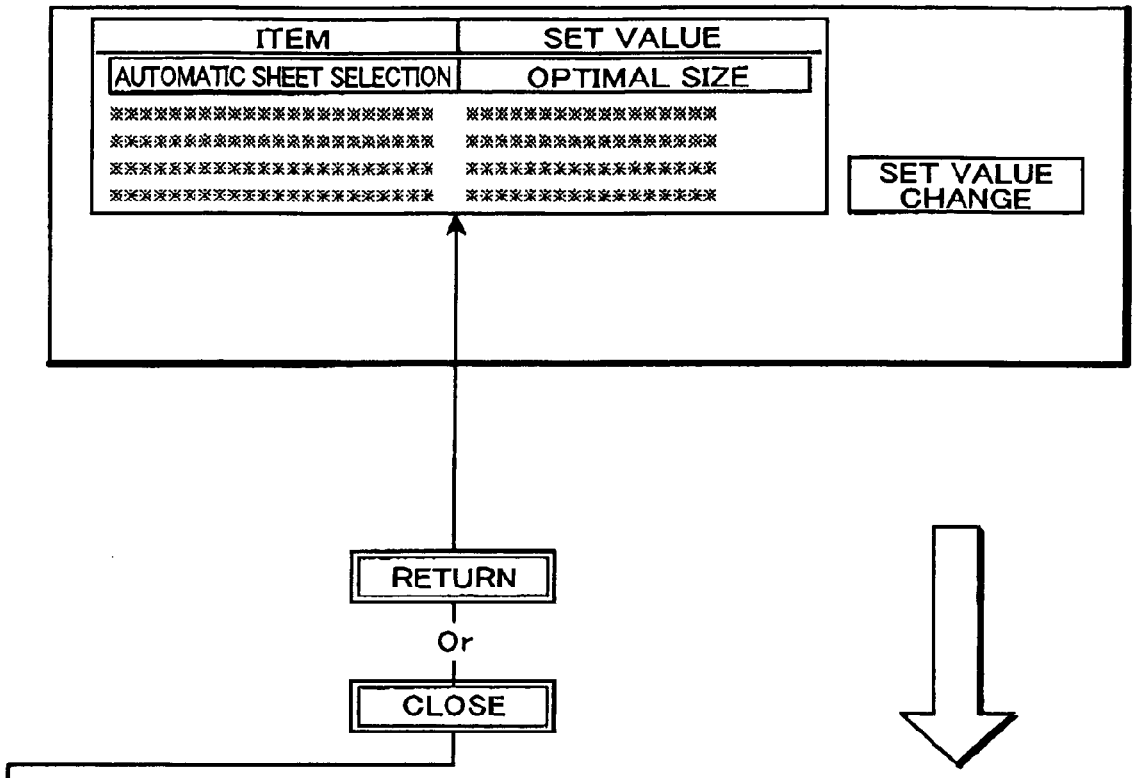
FIGS. 8A, 8B are diagrams showing operation screens displayed on a display unit when a user sets an operation mode to a document identical size mode.
Figure 8B:
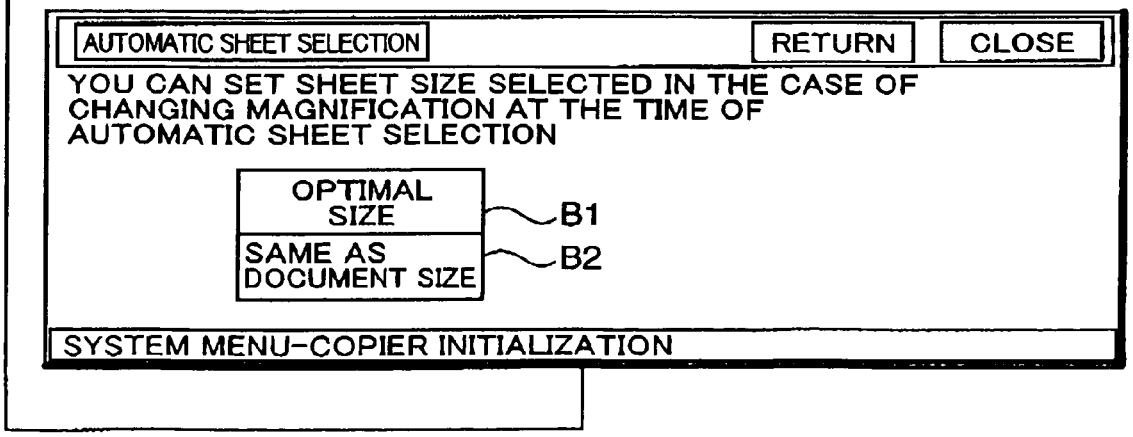

FIG. 8B is a diagram showing an operation screen displayed on the display unit 13 when the user sets the operation mode to the document identical size mode. The operation screen shown in FIG. 8B is displayed through the following procedure. First, when the user presses a system button (not shown) provided in the operation unit 14, the display controlling section 26 causes an operation screen shown in FIG. 9 to be displayed on the display unit 13.

Figure 9:
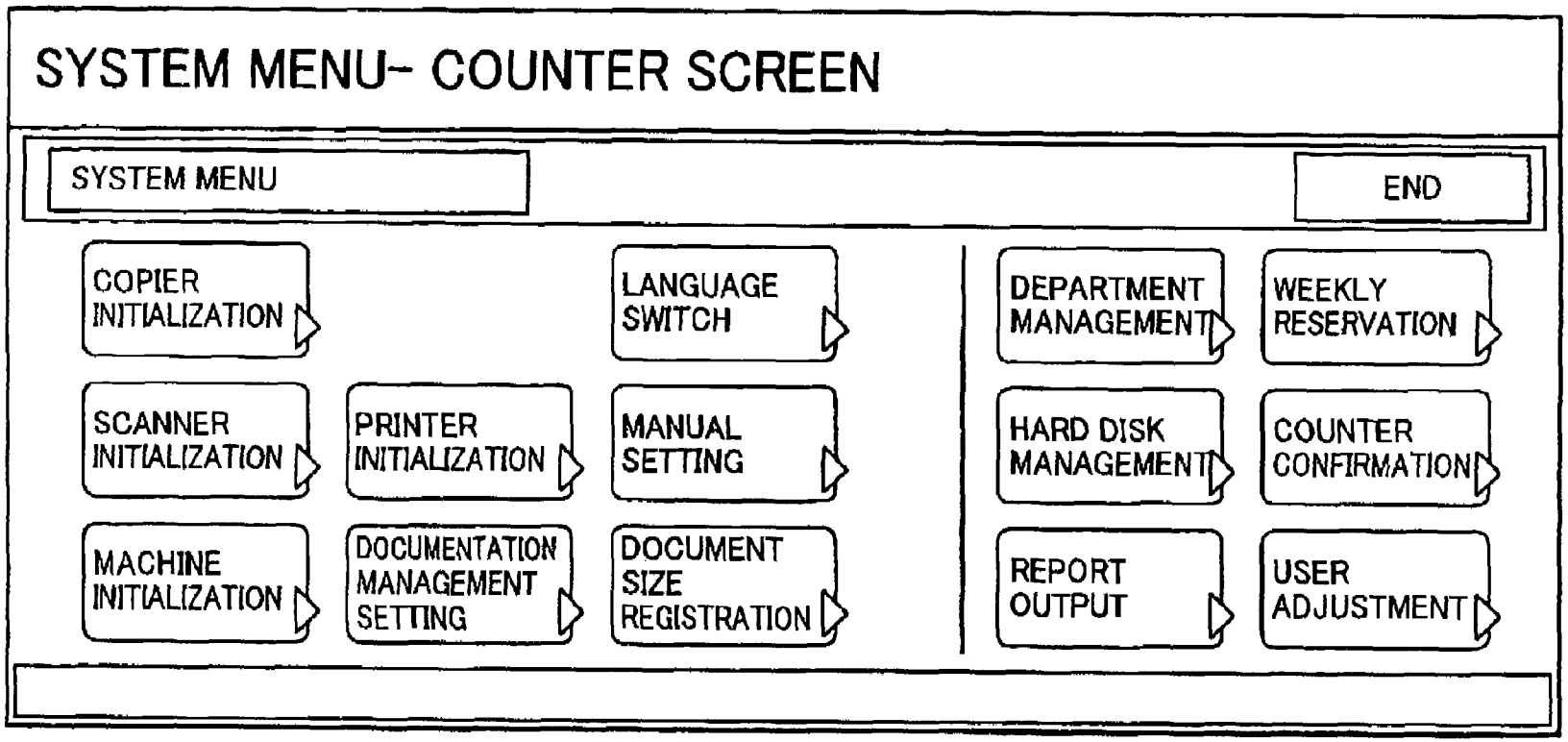
FIG. 9 is a diagram showing an operation screen displayed on the display unit when the user presses a system button provided on an operation unit.

Various operation buttons used to make various settings to the image forming apparatus are displayed on the operation screen shown in FIG. 9. When a button "Copier Initialization" is pressed on the operation screen shown in FIG. 9, the display controlling section 26 causes an operation screen shown in FIG. 10 to be displayed on the display 13.

Figure 10:
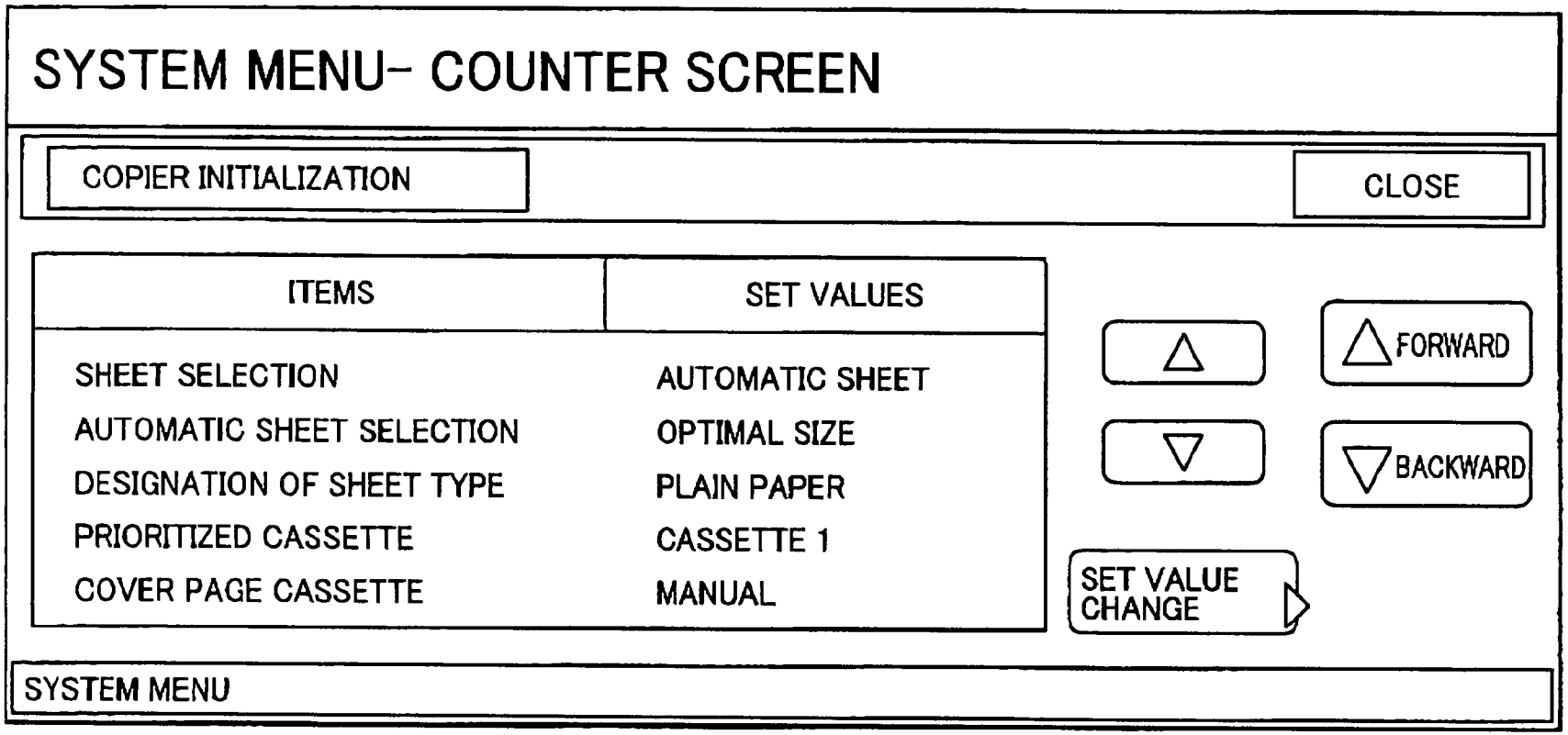
FIG. 10 is a diagram showing an operation screen displayed on the display unit when a "Copier Initialization" button is pressed on the operation screen shown in FIG. 9.

A plurality of items to be set and set values for the respective items are displayed on the operation screen shown in FIG. 10. Items such as "Sheet Selection", "Automatic Sheet Selection" and "Sheet Type Designation" are displayed in a column for the items to be set. On the right side of the operation screen shown in FIG. 10, buttons written with an up-arrow mark and a down-arrow mark are displayed. The user can select any one of the items to be set displayed in the column by pressing these buttons. The user presses a button written with "Set Value Change" displayed at the right bottom part of the operation screen with the item selected. Then, an operation screen shown in FIG. 8A is caused to be displayed on the display unit 13 by the display controlling section 26.

Five items to be set and set values for the respective items are displayed on the operation screen shown in FIG. 8A. As shown in the first row of FIG. 8A. "Optimal Size" is set for the item "Automatic Sheet Selection," which shows that the operation mode of the image forming apparatus is set at the optimal size node at present. When the button "Set Value Change" displayed at the right side of the operation screen shown in FIG. 8A is pressed, the display controlling section 26 causes the operation screen shown in FIG. 8B to be displayed on the display unit 13. In this way, the operation screen shown in FIG. 8B is displayed.

On the operation screen shown in FIG. 8B, a heading "Automatic Sheet Selection" is given and a button B1 written with "Optimal Size" and a button B written with "Same as Original Size" are displayed substantially in the center of the screen. If the user presses the button B1, the operation unit 14 receives an operation command for setting the operation mode to the optimal size mode. Thus, the mode setting section 21 sets the operation mode to the optimal size mode. On the other hand, if the user presses the button B2, the operation unit 14 receives an operation command for setting the operation mode to the document identical size mode. Thus, the mode setting section 21 sets the operation mode to the document identical size mode.

If a button written with "Close" or a button written with "Return" at the right upper corner of the operation screen shown in FIG. 8B is pressed, the display controlling section 26 causes the operation screen shown in FIG. 8A to be displayed on the display unit 13.

If the operation unit 14 receives an operation command by the user for setting the size of a document to be read in Step S43 shown in FIG. 7 (YES in Step S43), the document size setting section 28 sets the size of the document to be read to the document size the operation unit 14 received (Step S44). On the other hand, unless the operation unit 14 receives the operation command from the user for setting the size of the document to be read in Step S43 (NO in Step S43), the document size setting section 28 sets the document size detected by the document detecting sensors 606, 607 as the size of a recording sheet (Step S52) and this routine proceeds to Step S45.

Figure 11:
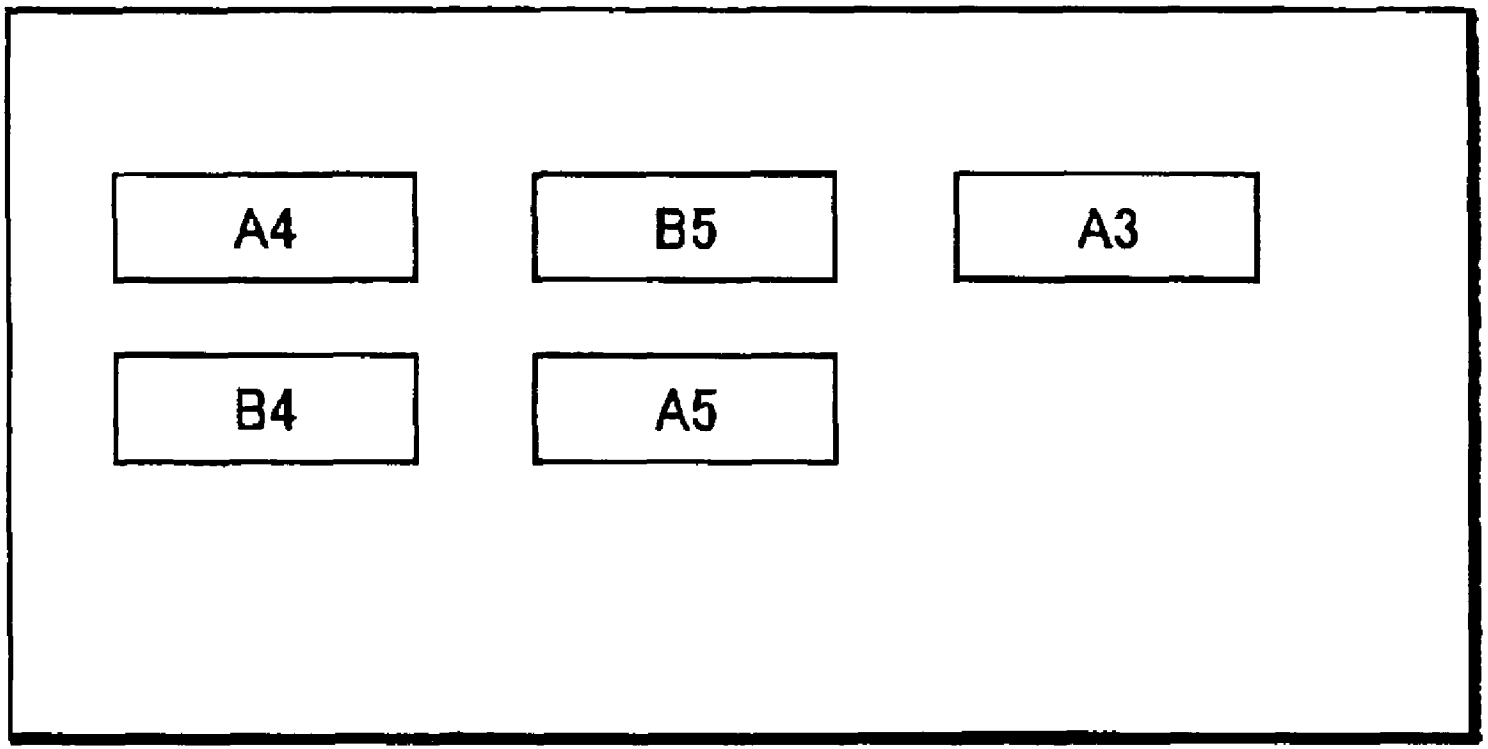
FIG. 11 is a diagram showing an operation screen displayed on the display unit upon setting the size of a recording sheet.
Figure 12:
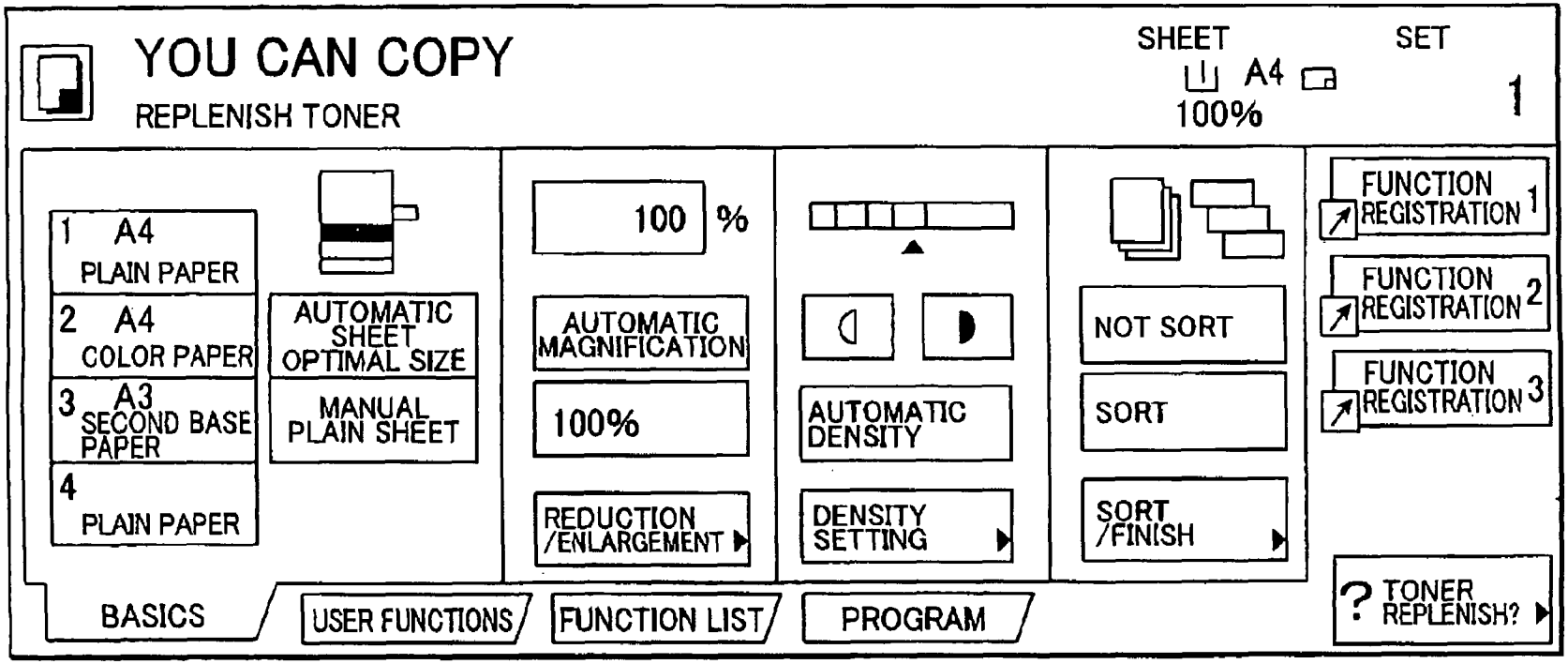
FIG. 12 is a diagram showing a default operation screen displayed on the display unit.

In such a case, the display controlling section 26 causes an operation screen shown in FIG. 11 used to set the size of the document to be displayed on the display unit 13. The operation screen shown in FIG. 11 is displayed as follows. FIG. 12 is a diagram showing one example of a default operation screen displayed on the display unit 13. If a button written with "Function List" arranged at the bottom is pressed on the operation screen shown in FIG. 12, the display controlling section 26 causes an unillustrated operation screen, in which various buttons for making various settings to the image forming apparatus are arranged, to be displayed on the display unit 13.

A button written with "Original Size Setting" is arranged on this unillustrated operation screen. If the user presses this button, the display controlling section 26 causes the operation screen shown in FIG. 11 to be displayed on the display unit 13.

Five buttons written with "A4", "B5", "A3", "B4" and "A5" are displayed on the operation screen shown in FIG. 11. If the operation unit 14 receives an operation command from the user pressing, for example, the button "A4", the document size setting section 28 sets the size of the document to be read to A4. In this way, the user sets the size of the document to be read by pressing any of these five buttons.

In Step S45 shown in FIG. 7, the recording-sheet selecting section 25*a* selects a recording sheet having the same size as the document size set by the document size setting section 22 as a recording sheet for image output. Although it can be thought that the size of the document is detected by the document size detecting section 24 before the operation in Step S45, the size of the document set by the user is selected as the size of the recording sheet for image output.

If the operation unit 14 receives an operation command from the user for designating the magnification of the document image in Step S46 (YES in Step S46), the magnification setting section 22 sets the magnification indicated by the operation command the operation unit 14 received as the magnification of the document image (Step S47). This routine changes the size of the document image (Step S48) and proceeds to Step S49 unless the operation unit 14 receives the operation command from the user for designating the magnification of the document image (NO in Step S46). In such a case, the magnification is set at 1:1 magnification.

In Step S48, the document size changing section 23 changes the size of the document image at the magnification set in Step S47. In Step S49, the display controlling section 26 generates a preview image to let the user know about a printed state of the document image having the size thereof changed by the document size changing section 23 on the recording sheet selected by the recording-sheet selecting section 25*a* before printing, and causes the generated preview image to be displayed on the display unit 13. If the operation unit 14 receives an operation command from the user for permitting the printing in Step S50 (YES in Step S50), the recording-sheet selecting section 25*a* drives the feed roller 202 corresponding to the sheet cassette 201 containing the recording sheets of the selected size to convey the recording sheet to the printing unit 15, and the printing controlling section 27 controls the printing unit 15 such that the document image having the size thereof changed by the document size changing section 23 is printed on the conveyed recording sheet (Step S51). On the other hand, the processing is ended if the operation unit 14 receives such an operation command as not to permit the printing in Step S50 (NO in Step S50).

As described above, according to the image forming apparatus of the second embodiment, the document image is printed on the recording sheet having the same size as the set size if the user sets the size of the document. Thus, the user can have the document image printed on the recording sheet having the same size as the document even without performing any separate operation of setting the size of the recording sheet. Further, by setting the size of the document, the document image can be printed on the recording sheet having a desired size different from the document to be actually read.

Third Embodiment

Figure 13:
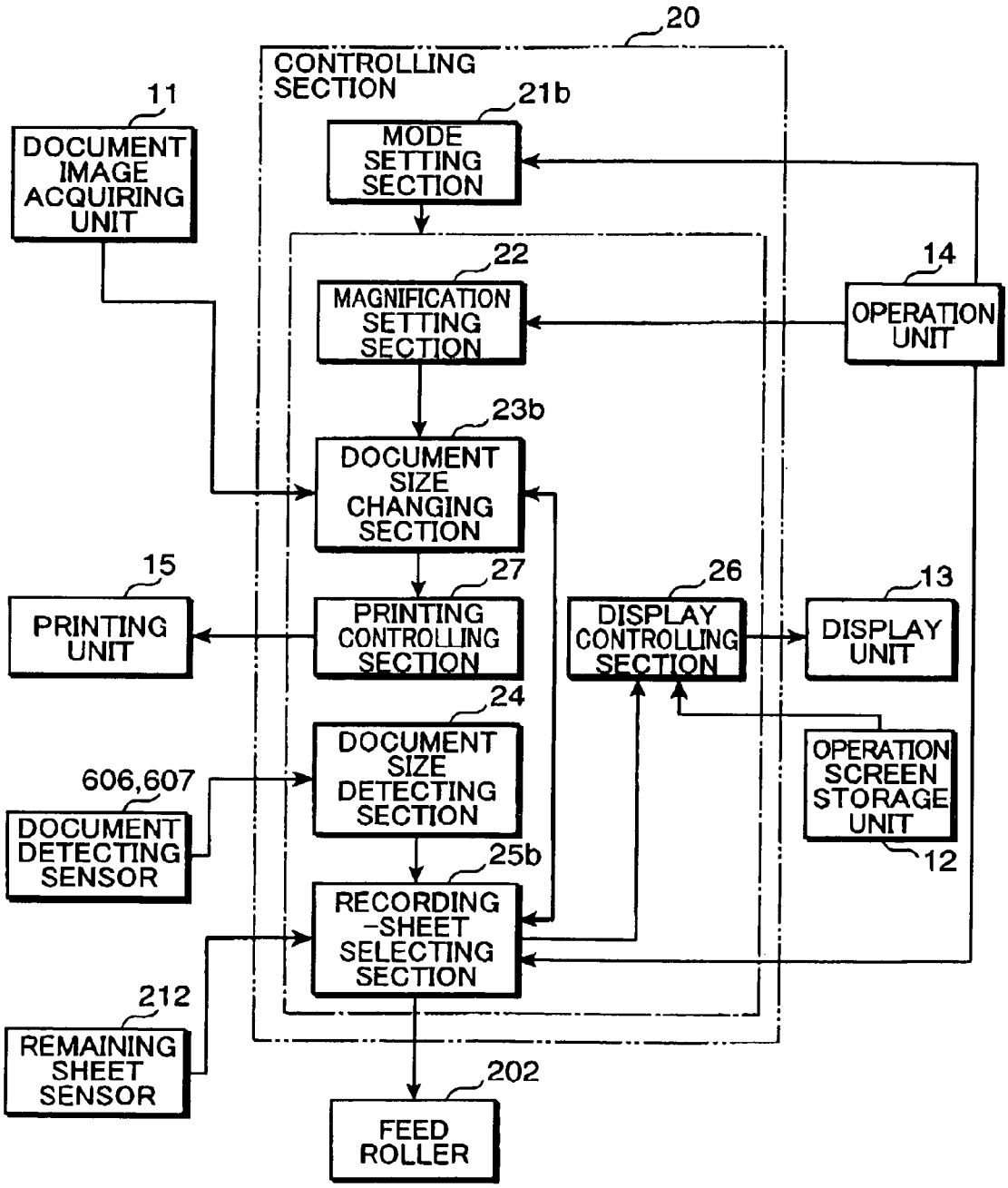
FIG. 13 is a block diagram showing an electrical construction of an image forming apparatus according to a third embodiment of the invention.

Next, an image forming apparatus according to a third embodiment is described. The image forming apparatus of the third embodiment is characterized by having a document magnification changing mode as an operation mode in addition to the optimal size mode, the document identical size mode and the manual mode and by judging the presence or absence of the recording sheet selected by the recording-sheet selecting section. FIG. 13 is a block diagram showing an electrical construction of the image forming apparatus of the third embodiment. The same elements as those of the first embodiment are identified by the same reference numerals and are not described.

A mode setting section 21*b* sets the operation mode of the image forming apparatus in accordance with an operation command inputted from a user and received by the operation unit 14 for setting the operation mode. The image forming apparatus has four operation modes; the optimal size mode, the document identical size mode, the document magnification changing mode and the manual mode. The document magnification changing mode is a mode in which the magnification of a document image is so set as to conform to a recording sheet of the size set by the user.

A document size changing section 23*b* changes the size of the document image acquired by the document image acquiring unit 11 in accordance with the magnification of the document image set by the magnification setting section 22 if the optimal size mode, the document identical size mode or the manual mode is set.

The document size changing section 23*b* sets the magnification of the document image in such a manner as to minimize a margin portion of a recording sheet having a size selected by a recording-sheet selecting section 25*b* (recording sheet having the size set by the user) if the magnification changing mode is set.

The recording-sheet selecting section 25*b* selects the size of the recording sheet to have the document image printed thereon in accordance with the operation mode presently set by the mode setting section 21*b*, and controls the feed roller 202 to convey the recording sheet of the selected size to the printing unit 15. Here, the recording-sheet selecting section 25*b* selects a recording sheet of the size conforming to the document image having the size thereof changed by the document image changing section 23*b* as a recording sheet to have the document image printed thereon if the optimal size mode is set.

The recording-sheet selecting section 25*b* selects a recording sheet having the same size as that of the document detected by the document size detecting section 24 as a recording sheet to have the document image printed thereon if the document identical size mode is set.

Further, the recording-sheet selecting section 25*b* selects a recording sheet of the size set by the user via the operation unit 14 as a recording sheet to have the document image printed thereon if the magnification changing mode or the manual mode is set.

Figure 14:
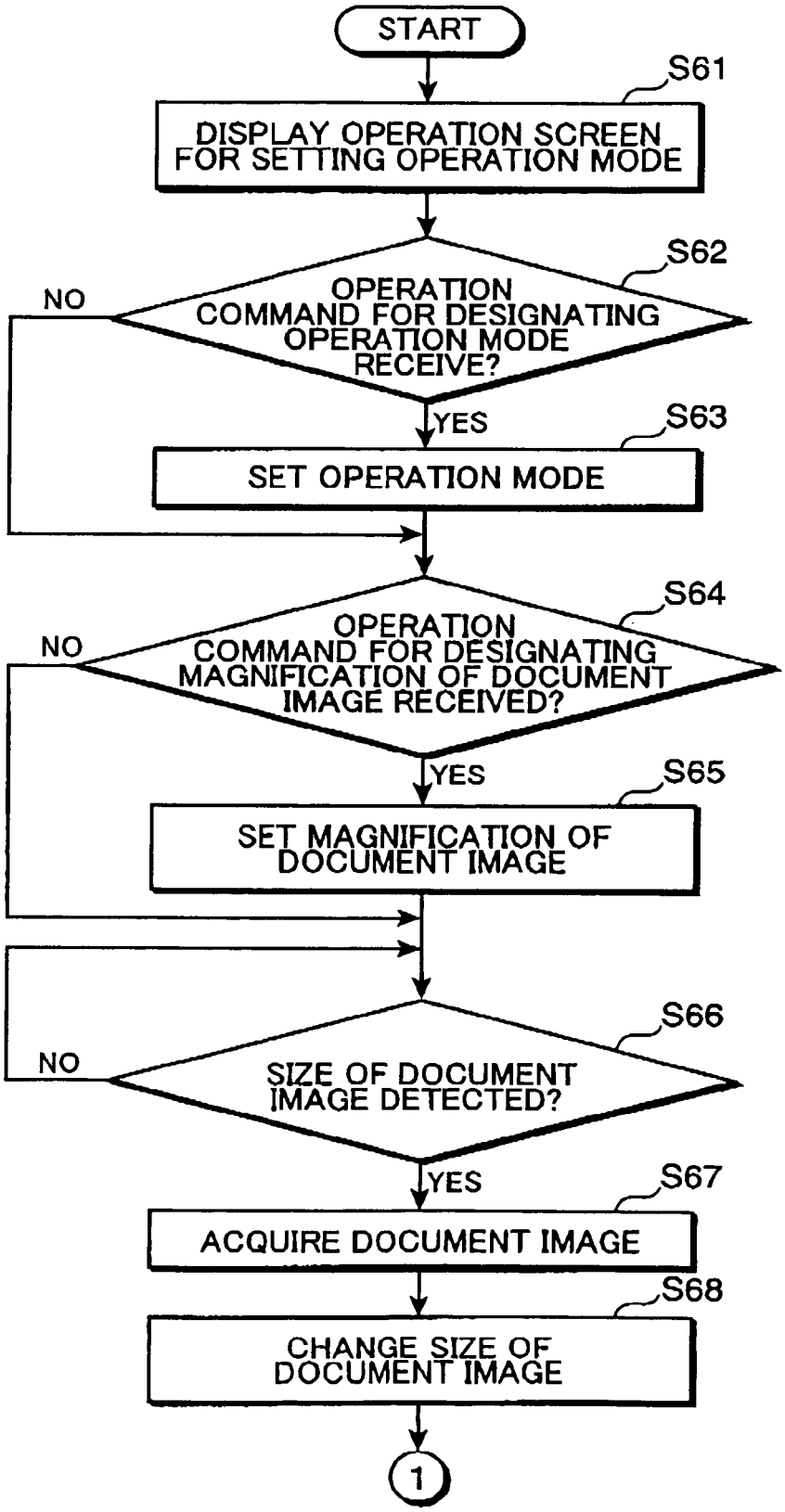
FIGS. 14 and 15 are a flow chart showing an operation of the image forming apparatus of the third embodiment when a user sets the magnification of a document before placing the document on a document placing portion or a contact glass.
Figure 15:
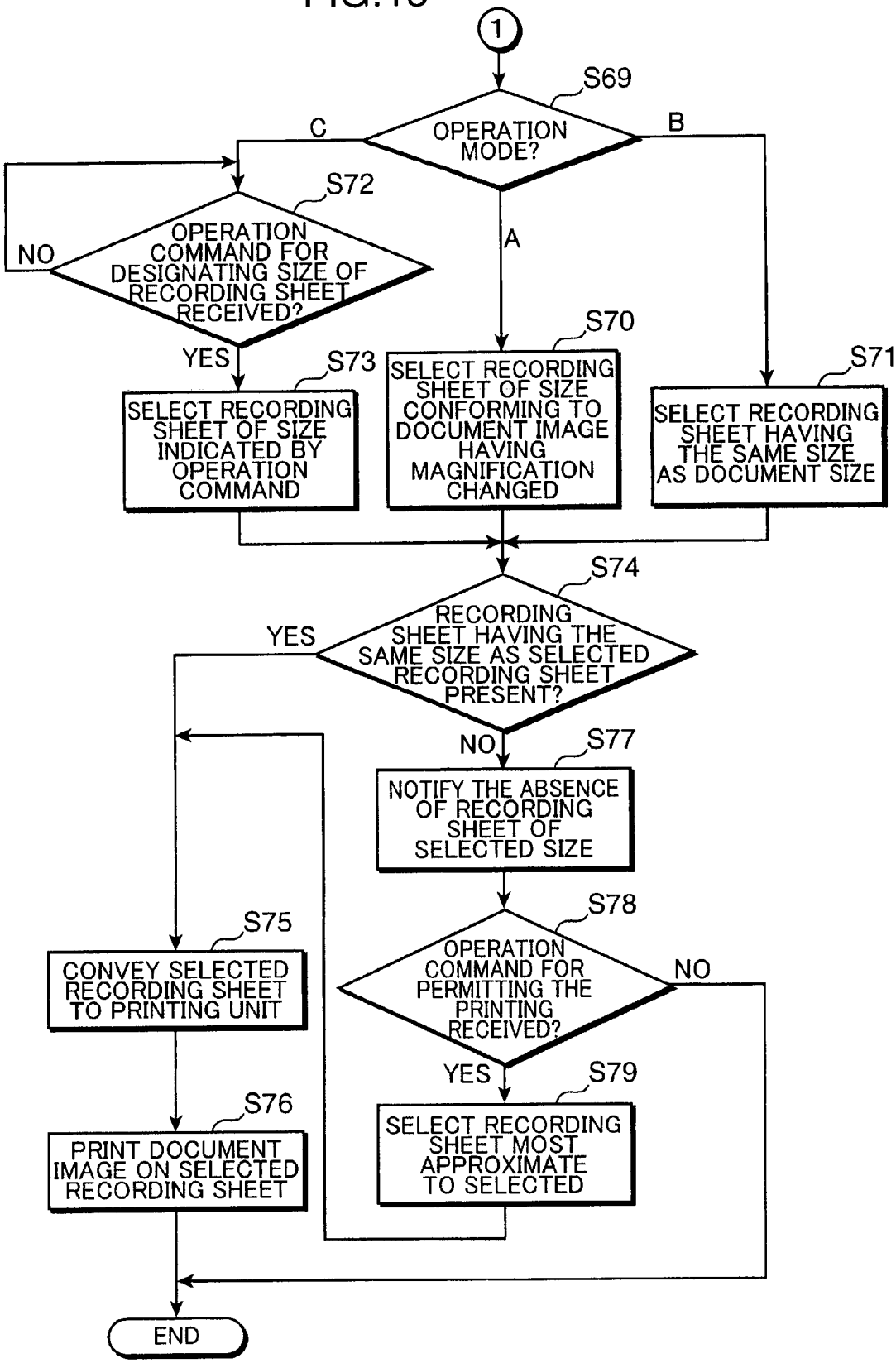
Figure 16:
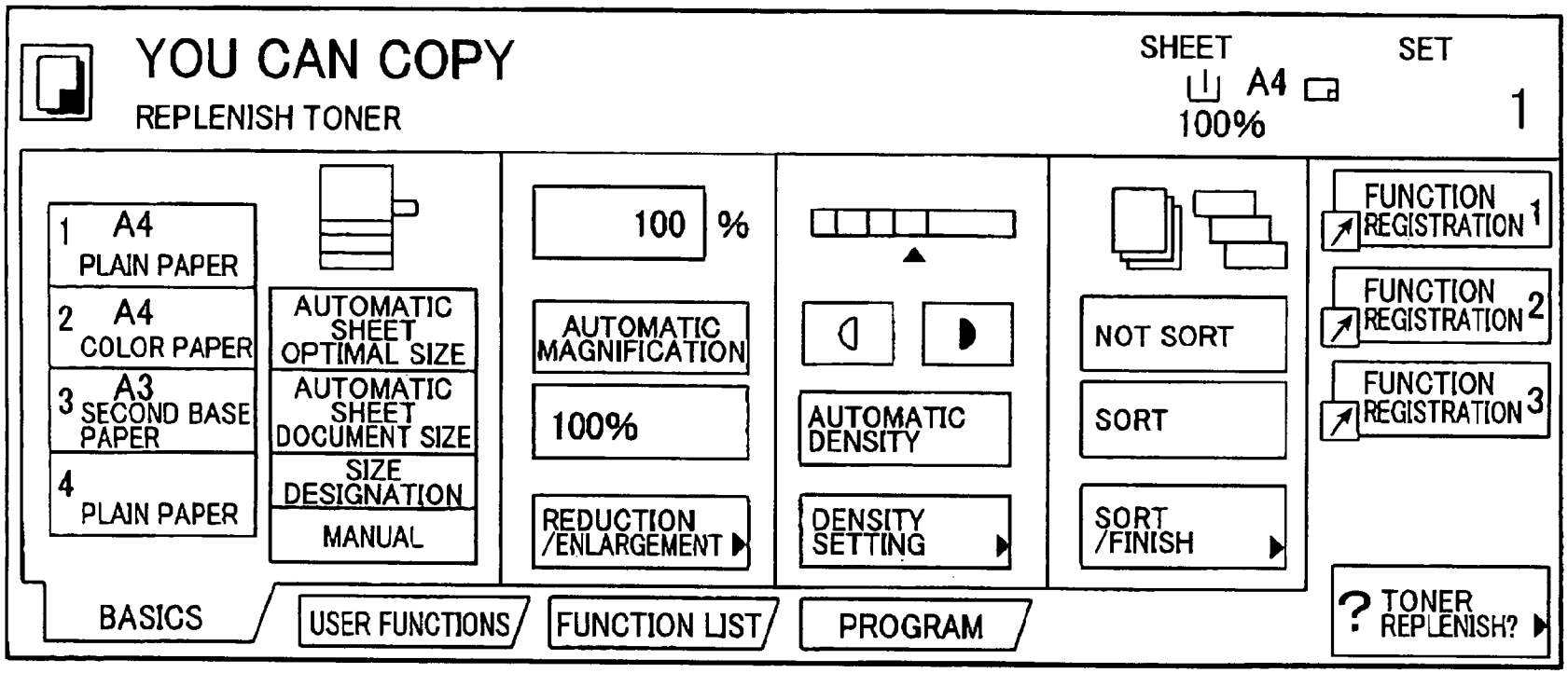
FIG. 16 is a diagram showing an operation screen displayed on a display unit when a user sets an operation mode.

FIGS. 14 and 15 are a flow chart showing the operation of the image forming apparatus when the user sets the magnification of the document before the size of the document is detected. The operation of the image forming apparatus is described below with reference to the flow chart of FIGS. 14 and 15. First, in Step S61, the display controlling section 26 reads an operation screen stored beforehand in the operation screen storage unit 12 and used to set the operation mode and causes it to be displayed on the display unit 13. FIG. 16 is a diagram showing one example of the operation screen caused to be displayed on the display unit 13 by the display controlling section 26 when the user sets the operation mode. In Step S61, an operation screen as shown in FIG. 16 is displayed.

If the operation unit 14 receives an operation command from the user for setting the operation mode in Step S62 (YES in Step S62), the mode setting section 21*b* sets the operation mode of the image forming apparatus to the one indicated by the operation command (Step S63). If the user presses a button "Automatic Sheet Optimal Size" displayed in the uppermost row of the second column of the operation screen shown in FIG. 16 from left, the mode setting section 21*b* sets the operation mode of the image forming apparatus to the optimal size mode. Further, if the user presses a button "Automatic Sheet Original Size" displayed below the button "Automatic Sheet Optimal Size", the mode setting section 21*b* sets the operation mode of the image forming apparatus to the document identical size mode.

Further, if the user presses a button "Size Designation" displayed below the button "Automatic Sheet Original Size", the mode setting section 21*b* sets the operation mode of the image forming apparatus to the magnification changing mode. Further, if the user presses a button "Manual" displayed below the button "Size Designation", the mode setting section 21*b* sets the operation mode of the image forming apparatus to the manual mode.

On the other hand, unless the operation unit 14 receives the operation command from the user for setting the operation mode in Step S62 of FIG. 14 (NO in Step S62), this routine proceeds to S64. In this case, the default operation mode or the operation mode previously set is set as the operation mode.

If the operation unit 14 receives an operation command form the user for setting the magnification of the document image in Step S64 (YES in Step S64), the magnification setting section 22 sets the magnification indicated by the operation command as the magnification of the document image (Step S65). Here, the user sets the magnification of the document image by inputting a numerical value using the numerical keypad 403 in a magnification designating box displayed at the top in the third column from left on the operation screen shown in FIG. 16.

On the other hand, this routine proceeds to Step S66 unless the operation unit 14 receives the operation command from the user for setting the magnification of the document image in Step S64 (NO in Step S64). In this case, the magnification is set at 1:1 magnification (100%).

If a document is placed on the contact glass 605 by the user and the document size detecting section 24 detects the size of the placed document in Step S66 (YES in Step S66), the document image acquiring unit 11 optically reads the placed document to acquire the document image (Step S67). On the other hand, this routine returns to Step S66 if no document is placed on the contact glass 605 by the user and, therefore, the document size detecting section 24 does not detect the size of the document (NO in Step S66).

In Step S68, the document size changing section 23*b* changes the size of the document image acquired by the document image acquiring unit 11 at the magnification set by the magnification setting section 22. If the optimal size mode is set in Step S69 (A in Step S69), the recording-sheet selecting section 25*b* selects a recording sheet of the size conforming to the document image having the size thereof changed as a recording sheet to have the document image printed thereon (Step S70). Here, the recording-sheet selecting section 25*b* selects, out of recording sheets contained in the sheet cassettes 201, the one having such a size as to minimize the area of a margin portion of the document image having the size thereof changed as the recording sheet to have the document image printed thereon.

If the document identical size mode is set in Step S69 (B in Step S69), the recording-sheet selecting section 25*b* selects a recording sheet having the same size as that of the document detected by the document size detecting section 24 as a recording sheet to have the document image printed thereon (Step S71). If the magnification changing mode or the manual mode is set (C in Step S69), the operation unit 14 receives an operation command from the user for setting the size of a recording sheet (YES in Step S72) and the recording-sheet selecting section 25*b* selects a recording sheet of the size indicated by the operation command as a recording sheet to have the document image printed thereon (Step S73). It should be noted that this routine returns to Step S72 unless the operation unit 14 receives the operation command from the user for setting the size of the recording sheet (NO in Step S72).

In Step S74, the recording-sheet selecting section 25*b* judges based on detection signals from the remaining sheet sensors 212 as to whether or not there is any recording sheet having the same size as the one selected in Step S70, S71 or S73. If such a recording sheet is present (YES in Step S74), the recording-sheet selecting section 25*b* drives the feed roller 202 corresponding to the recording sheet of the selected size to convey the selected recording sheet to the printing unit 15 (Step S75), and the printing controlling section 27 controls the printing unit 15 so that the document image having the size thereof changed by the document size changing section 23*b* is printed on the recording sheet selected by the recording-sheet selecting section 25*b* (Step S76).

On the other hand, if the recording-sheet selecting section 25*b* judges the absence of the recording sheet having the same size as the selected recording sheet in Step S74 (NO in Step S74), the display controlling section 26 reads an operation screen used to notify the user of the absence of the recording sheet having the same size as the recording sheet selected by the recording-sheet selecting section 25*b* from the operation screen storage unit 12, and causes it to be displayed on the display unit 13 (Step S77). An operation button for receiving an operation command from the user as to whether or not the printing is to be carried out is displayed on this operation screen.

If the operation unit 14 receives an operation command from the user for permitting the printing in Step S78 (YES in Step S78), the recording-sheet selecting section 25*b* selects a recording sheet having a size most approximate to that of the selected recording sheet as a recording sheet to have the document image printed thereon (Step S79). For example, the recording-sheet selecting section 25*b* selects a recording sheet of such a size whose area is most approximate to that of the recording sheet selected first as the recording sheet to have the document image printed thereon. Specifically, a selection table in which one or a plurality of sizes of recording sheets are written in such an order of having a more approximate area for the respective sizes of A4, B4, etc. is stored beforehand in a storage device such as a ROM, and the recording sheet is selected by referring to this selection table.

The recording-sheet selecting section 25*b* may select a recording sheet having an area larger than and most approximate to the recording sheet selected first as the recording sheet to have the document image printed thereon. In this way, an unprinted area of the document image having the size thereof changed on the recording sheet can be made smaller in the case that the document identical size mode or the manual mode is set.

On the other hand, this routine is ended if the operation unit 14 receives an operation command from the user not to permit the printing in Step S78 (NO in Step S78).

After the operation in Step S79 is completed, operations in Steps S75, S76 are carried out to print the document image having the size thereof changed by the document size changing section 23*b* on the recording sheet selected by the recording-sheet selecting section 25*b*, and this routine is ended.

Figure 17:
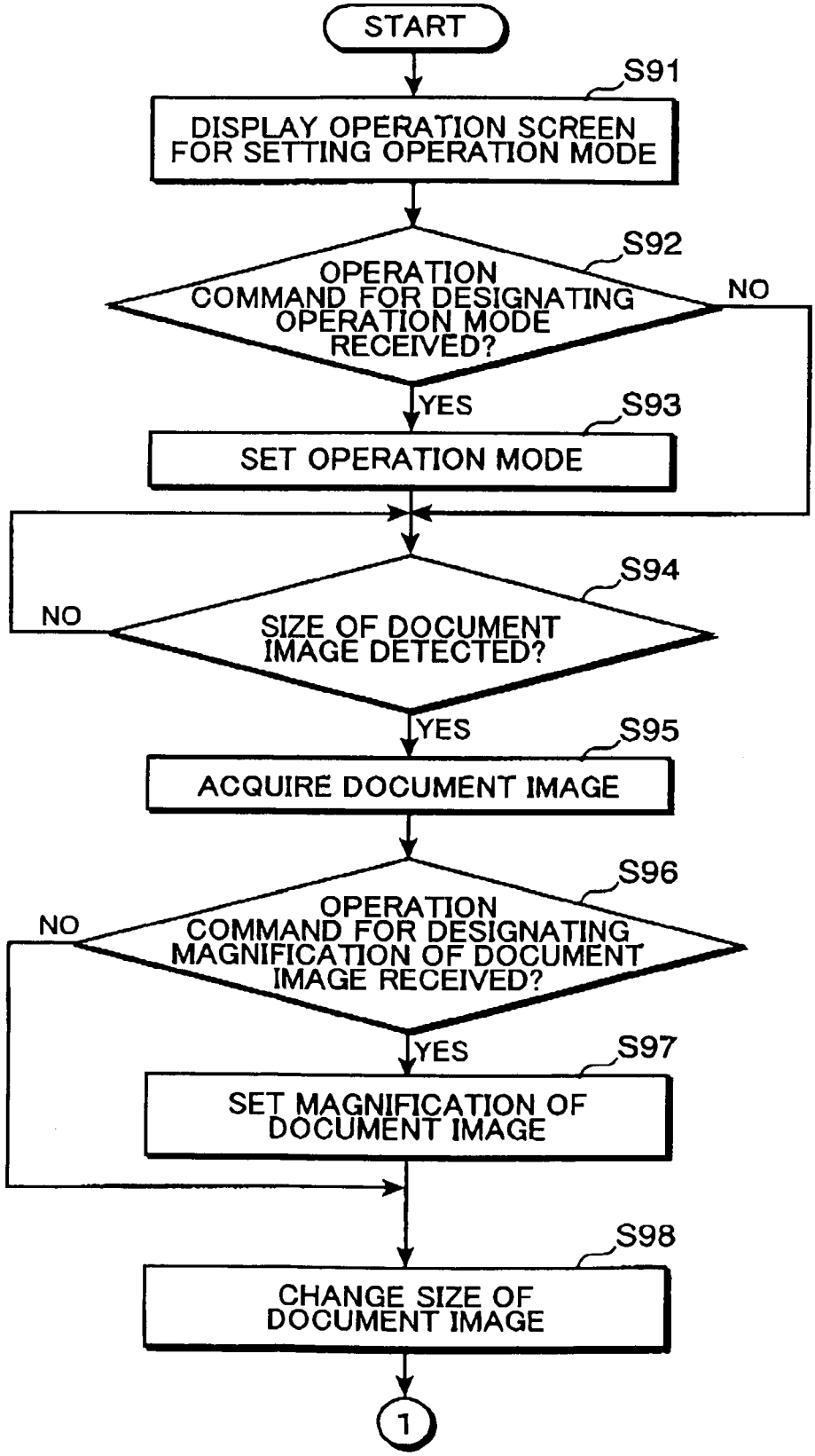
FIGS. 17 and 18 are a flow chart showing the operation of the image forming apparatus of the third embodiment when the user sets the magnification of the document after placing the document on a document placing portion or a contact glass.
Figure 18:
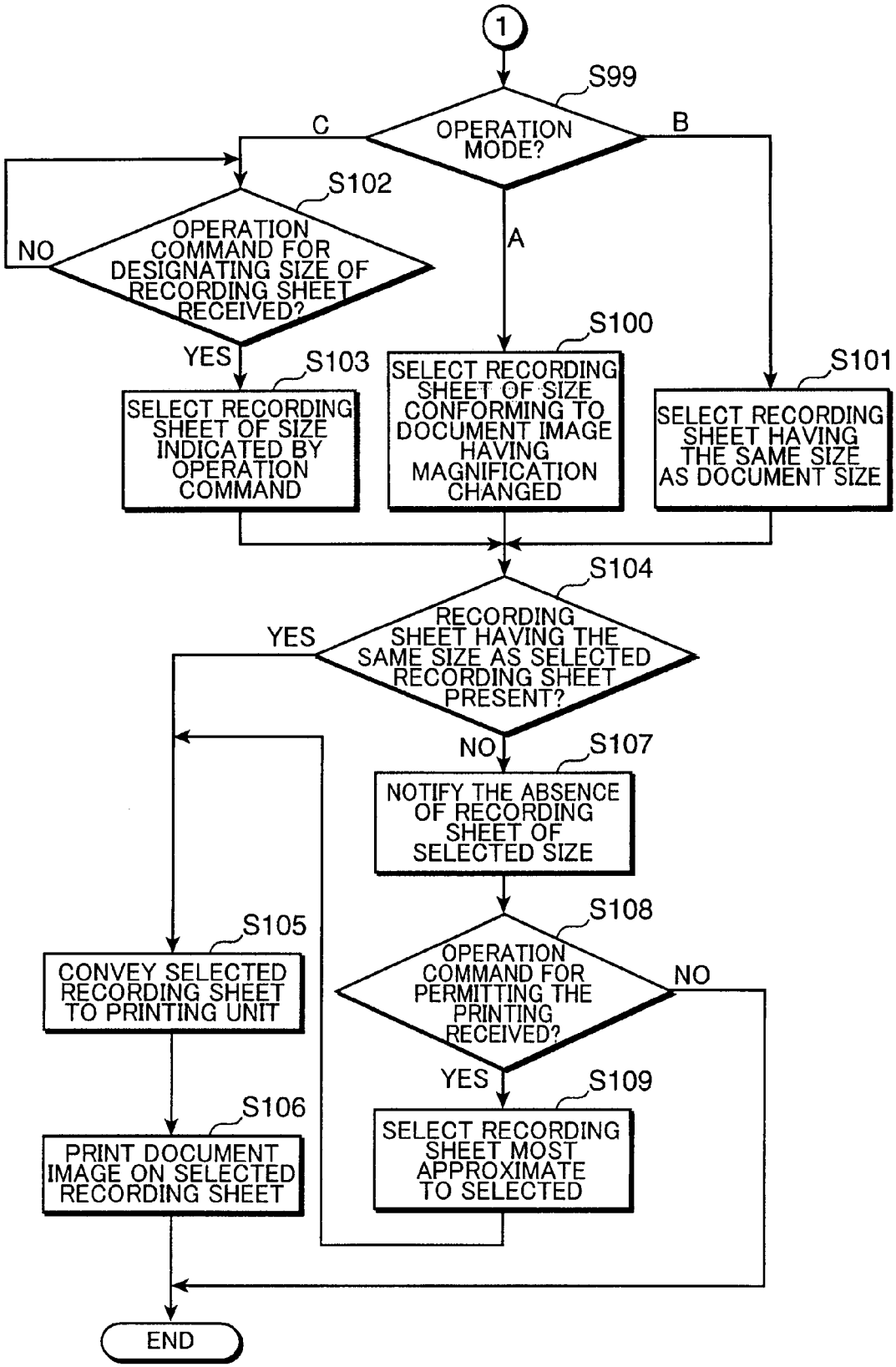

Next, the operation of the image forming apparatus when the user sets the magnification of a document after placing the document on the contact glass 605 is described. FIGS. 17 and 18 are a flow chart showing the operation in this case.

First, in Step S91, the display controlling section 26 reads an operation screen stored beforehand in the operation screen storage unit 12 and used to set the operation mode, and causes it to be displayed on the display unit 13.

If the operation unit 14 receives an operation command from the user for setting the operation mode in Step S92 (YES in Step S92), the mode setting section 21*b* sets the operation mode of the image forming apparatus to the one indicated by the operation command (Step S93).

On the other hand, unless the operation unit 14 receives the operation command from the user for setting the operation mode in Step S92 (NO in Step S92), this routine proceeds to S94. In this case, the default operation mode or the operation mode previously set is set as the operation mode.

If a document is placed on the contact glass 605 by the user and the document size detecting section 24 detects the size of the placed document in Step 94 (YES in Step S94), the document image acquiring unit 11 optically reads the placed document to acquire the document image (Step S95). On the other hand, this routine returns to Step S94 if no document is placed on the contact glass 605 by the user and, therefore, the document size detecting section 24 does not detect the size of the document (NO in Step S94).

If the operation unit 14 receives an operation command form the user for setting the magnification of the document image in Step S96 (YES in Step S96), the magnification setting section 22 sets the magnification indicated by the operation command as the magnification of the document image (Step S97). On the other hand, this routine proceeds to Step S98 unless the operation unit 14 receives the operation command form the user for setting the magnification of the document image in Step S96 (NO in Step S96). In this case, the magnification is set at 1:1 magnification (100%).

Since operations in following Steps S99 to S109 are same as those in Steps S69 to S79 shown in FIG. 15, no description is given here.

As described above, according to the image forming apparatus of the third embodiment, the document identical size mode can be set if it is desired to print the document image on the recording sheet having the same size as the document to be read: the optimal size mode can be set if it is desired to print the entire document image having the size thereof changed without leaving any part unprinted; the magnification changing mode can be set if it is desired to set the magnification of the document image such that the size of the document image is optimal for the size of the set recording sheet; and the manual mode can be set if it is desired to set both the magnification of the document image and the size of the recording sheet. Thus, the user can precisely understand the operation modes settable in the image forming apparatus. As a result, such an event where the document image is printed on the recording sheet having a size against the user's intension can be avoided. Further, in the absence of the recording sheet having the same size as the recording sheet selected first by the recording-sheet selecting section 25*b*, a recording sheet having a size more approximate to this size is selected. Thus, the document image can be printed on the recording sheet having a size most approximate to the one desired by the user.

Further, even if the user sets the magnification of the document image before the size of the document is detected with the document identical size mode set, the mode setting section 21*b* does not change the operation mode to the manual mode. Thus, the user needs not input the operation command for setting the size of the recording sheet to have the document image printed thereon after inputting the operation command for setting the magnification of the document image. Therefore, the operation load on the user can be mitigated.

Furthermore, even if the user sets the magnification after the size of the document is detected with the document identical size mode set, the operation mode is not changed. Thus, the user needs not set the size of the recording sheet after setting the magnification. Therefore, the operation load on the user can be mitigated.

Fourth Embodiment

Figure 19:
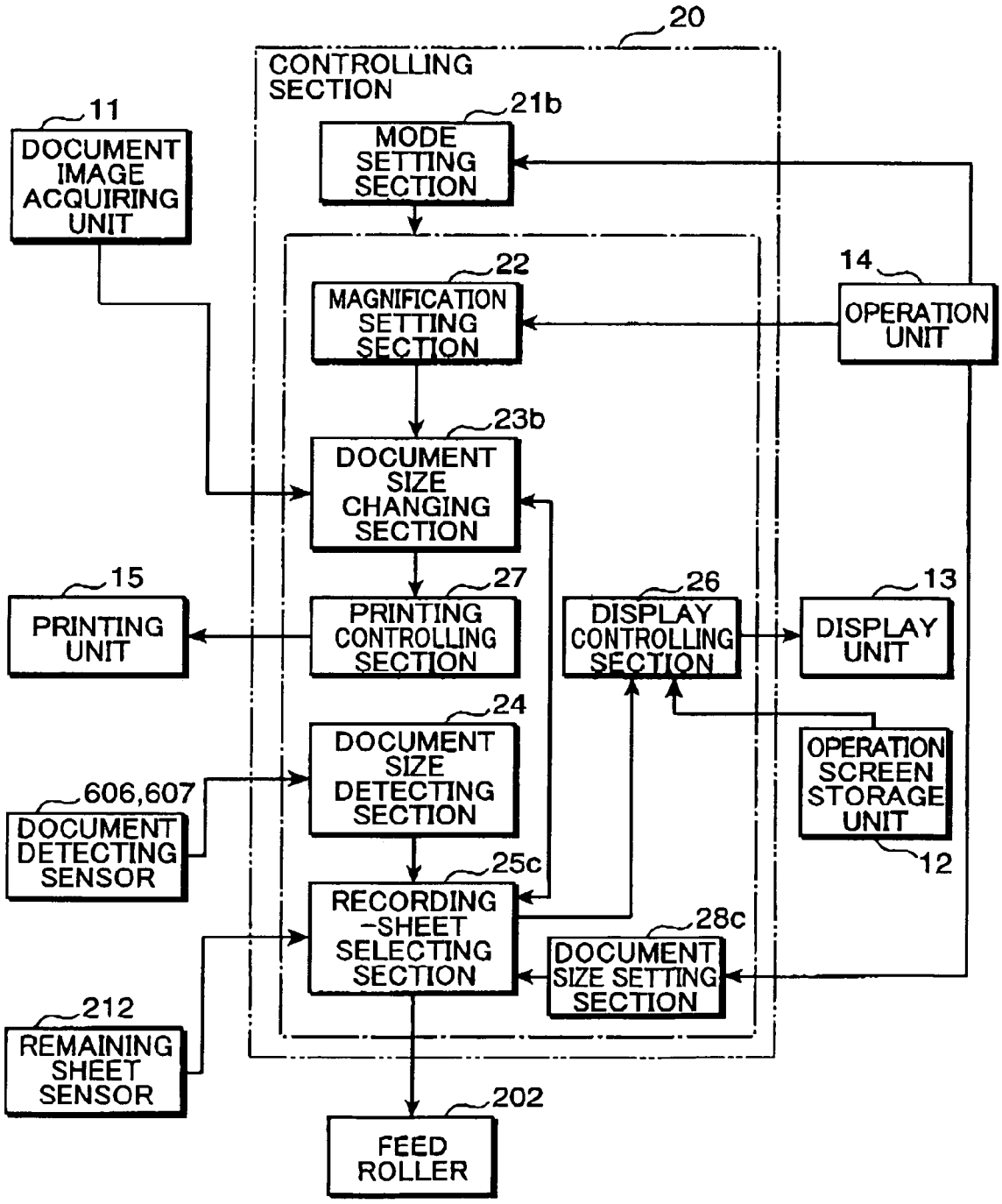
FIG. 19 is a block diagram showing an electrical construction of an image forming apparatus according to a fourth embodiment of the invention.

Next, an image forming apparatus according to a fourth embodiment is described. This image forming apparatus is characterized in that the size of the document set by the user in the image forming apparatus of the third embodiment is determined as the size of the recording sheet for image output. FIG. 19 is a block diagram showing an electrical construction of the image forming apparatus according to the fourth embodiment. It should be noted that the same elements as those of the third embodiment are identified by the same reference numerals and are not described in the fourth embodiment.

A recording-sheet selecting section 25*c* differs from the recording-sheet selecting section 25*b* of the third embodiment in selecting a recording sheet having the same size as that of a document detected by the document size detecting section 24 or a recording sheet having the same size as a recording sheet set by a document size setting section 28*c* as a recording sheet to have a document image printed thereon.

The document size setting section 28*c* sets the size of a document to be read in accordance with an operation command inputted from a user via the operation unit 14.

The display controlling section 26 reads various operation screens stored in the operation screen storage unit 12 and causes them to be displayed on the display unit 13. The printing controlling section 27 controls the printing unit 15 such that a document image having the size thereof changed by the document size changing section 23*b* is printed on the recording sheet.

Figure 20:
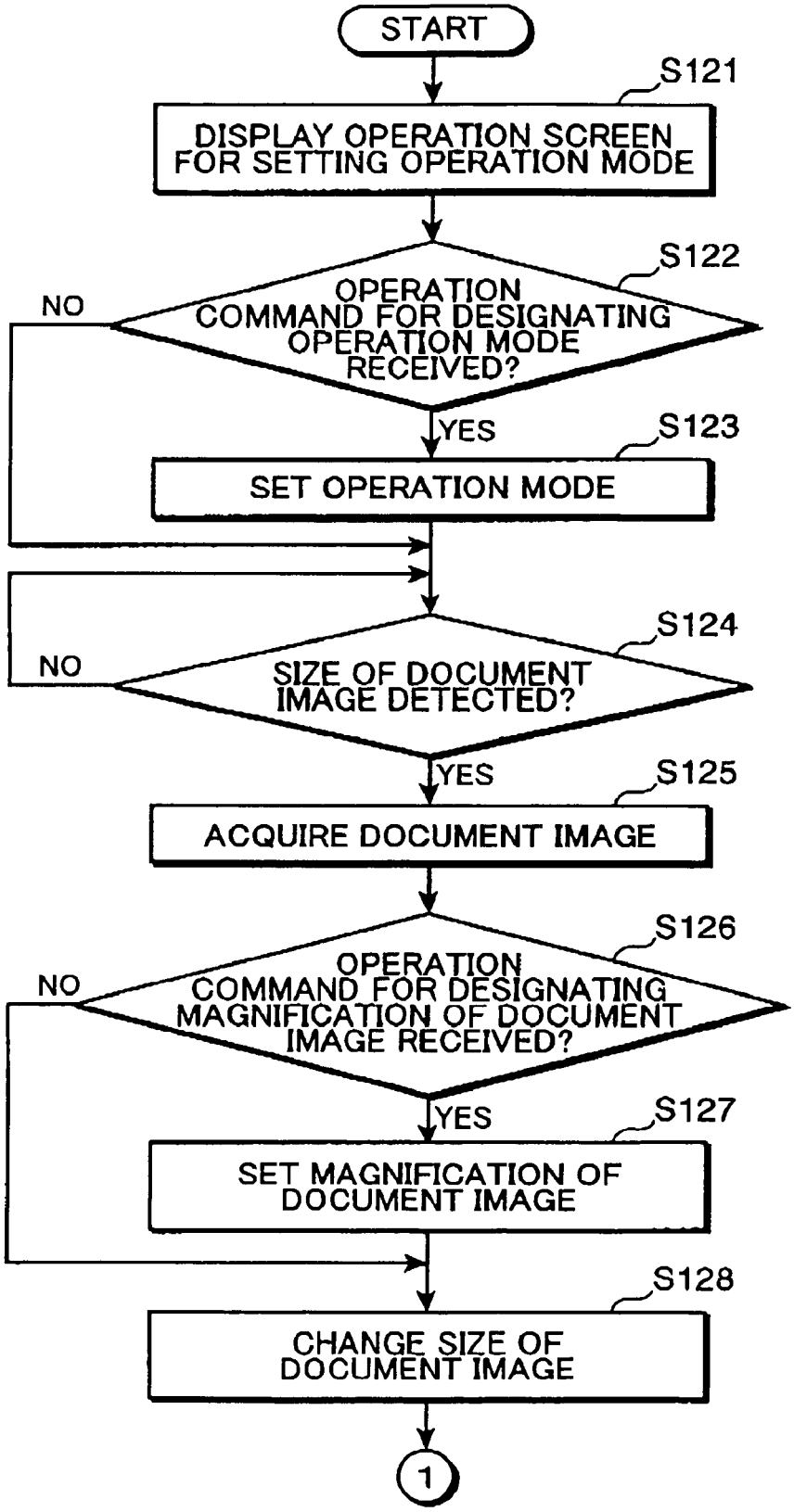
FIGS. 20 to 22 are a flow chart showing the operation of the image forming apparatus according to the fourth embodiment.
Figure 21:
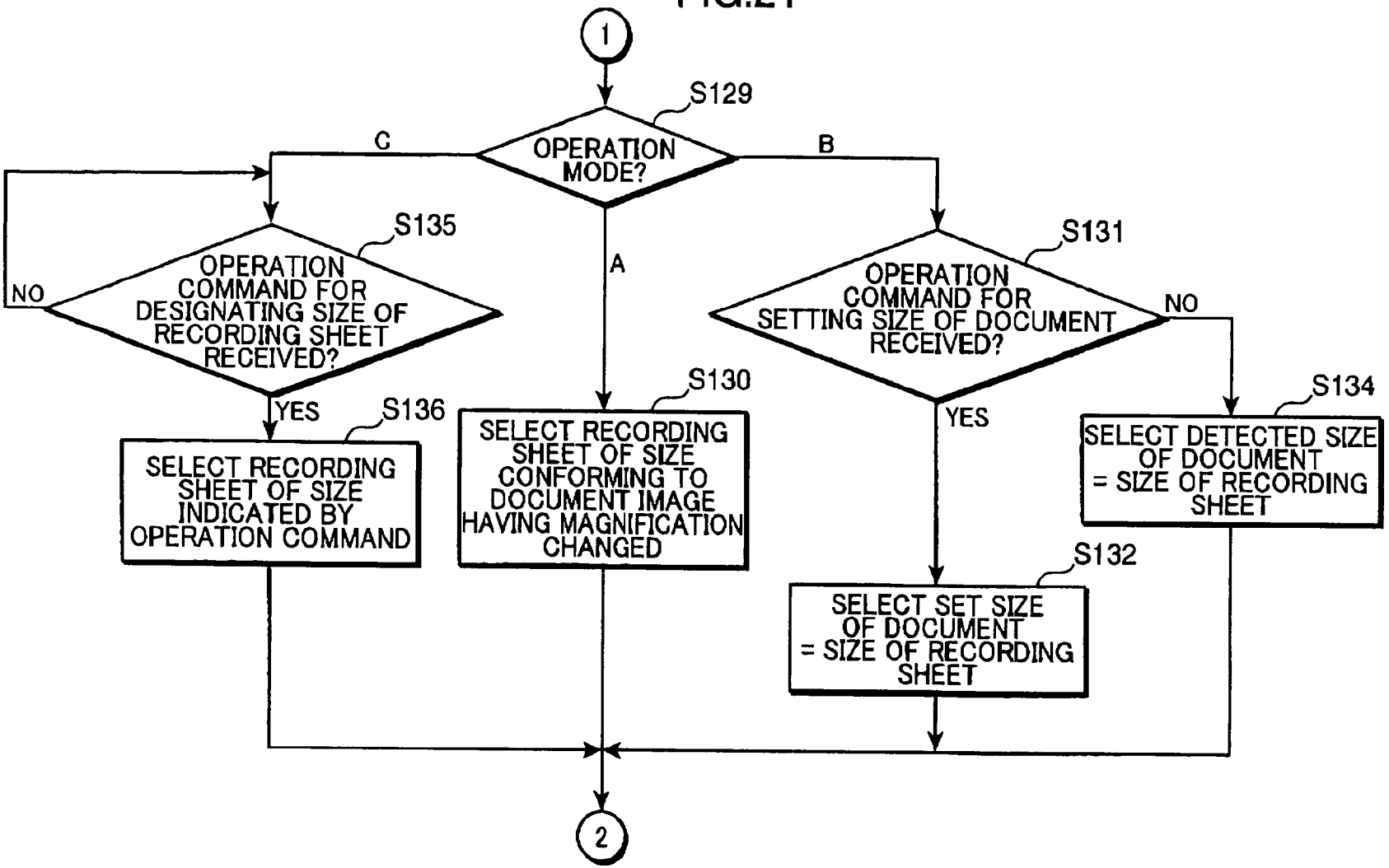
Figure 22:
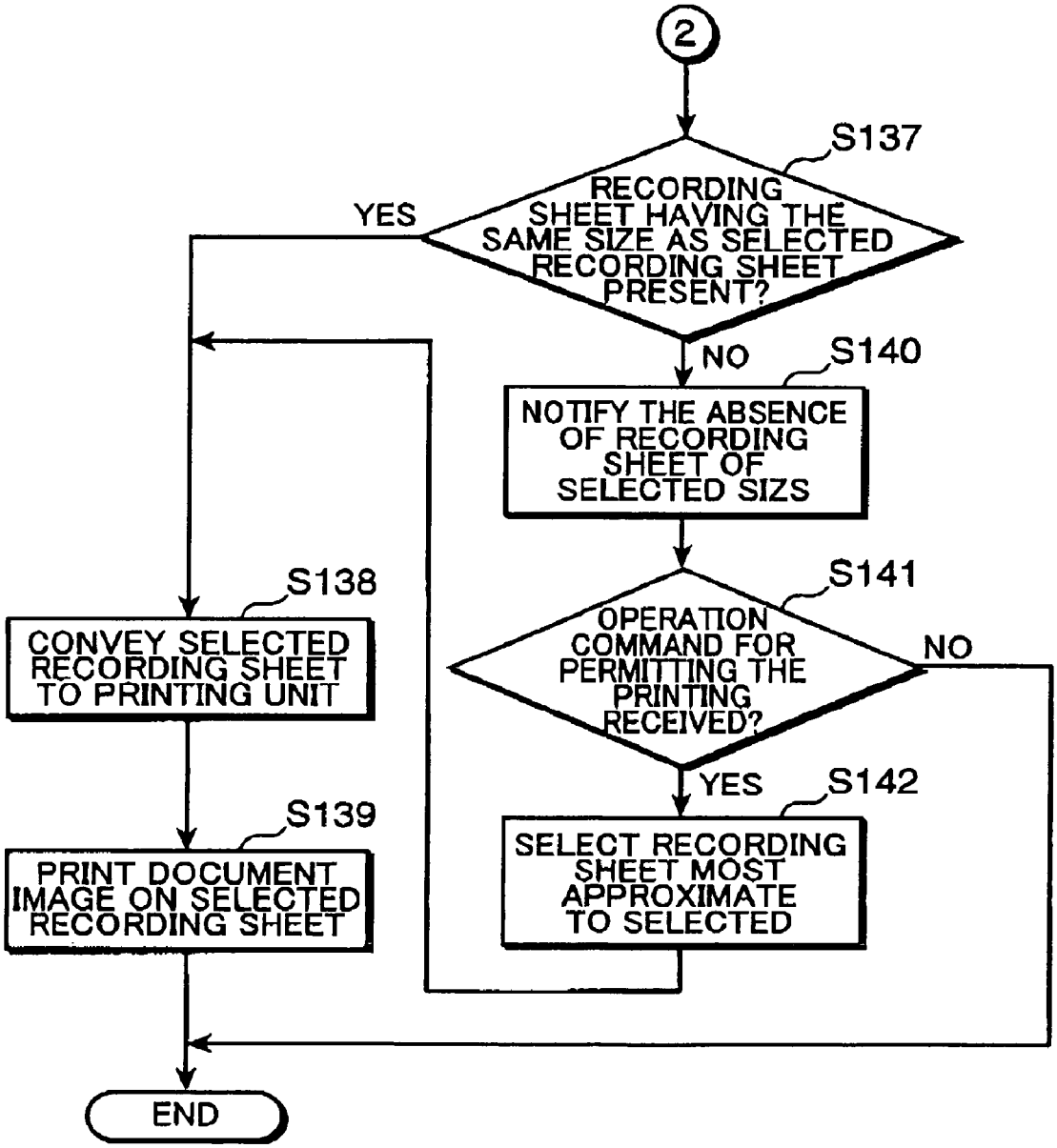

FIGS. 20 to 22 are a flow chart showing the operation of the image forming apparatus according to the fourth embodiment. The operation of this image forming apparatus is described with reference to the flow chart shown in FIGS. 20 to 22. Since operations in Steps S121 to S128 are same as those in Steps S91 to S98 shown in FIG. 17, no description is given here.

In Step S129, the recording-sheet selecting section 25*c* selects a recording sheet having a size conforming to the document image having the size thereof changed as a recording sheet to have the document image printed thereon (Step S130) if the optimal size mode is set (A in Step S129). Here, the recording-sheet selecting section 25*c* selects, out of recording sheets contained in the sheet cassettes 201, the one having such a size as to minimize the area of a margin portion of the document image having the size thereof changed as the recording sheet to have the document image printed thereon.

If the document identical size mode is set in Step S129 (B in Step S129), this routine proceeds to Step S131. If the operation unit 14 receives an operation command for setting the size of the document in Step S131 (YES in Step S131), the document size setting section 28*c* sets the size of the document in accordance with the received operation command, and the recording-sheet selecting section 25*c* selects the size of the document set by the document size setting section 28*c* as the size of the recording sheet for image output (Step S132).

On the other hand, unless the operation unit 14 receives the operation command for setting the size of the document in Step S131 (NO in Step S131), the recording-sheet selecting section 25*c* selects the size of the document detected by the document size detecting section 24 as the size of the recording sheet for image output (Step S134).

If the magnification changing mode or the manual mode is set (C in Step S129), the operation unit 14 receives an operation command from the user for setting the size of the recording sheet (YES in Step S135), and the recording-sheet selecting section 25*c* selects the recording sheet having a size indicated by the operation command as the recording sheet to have the document image printed thereon (Step S136). Since operations in Steps S137 to S142 shown in FIG. 22 are same as those in Steps S104 to S109 shown in FIG. 18, no description is given here.

As described above, according to the image forming apparatus of the fourth embodiment, the document image is printed on the recording sheet having the same size as the set size if the size of the document is set by the user. Thus, the document image can be printed on the recording sheet having the same size as the document even without the user separately setting the size of the recording sheet. Further, the document image can be printed on the recording sheet having a desired size different from the document to be actually read by setting the size of the document.

Although the document is placed on the contact glass 605 in the first to fourth embodiments, the present invention is also applicable to cases where the document is placed on the document placing portion 601.

As described above, there are the following characteristic features in the novel image forming apparatus.

(1) The image forming apparatus is characterized by comprising the image acquiring unit for reading an image of a document to acquire a document image, and the mode setting section for setting the operation mode to the document identical size mode in which the document image is outputted on the recording sheet having the same size as the document regardless of the magnification set by the user.

According to this construction, since the document identical size mode is provided in which the document image is printed on the recording sheet having the same size as the document regardless of the magnification of the document image, the document image having the magnification thereof changed can be printed on the recording sheet having the same size as the document even if the user sets the magnification to change the magnification of the document image. Thus, the document image can be printed on the recording sheet having the same size as the document even without the user setting the size of the recording sheet.

(2) Preferably, in the above construction, the size detecting section for detecting the size of the document is further provided and the document image is outputted on the recording sheet having the same size as that of the document detected by the size detecting section in the document identical size mode.

With this construction, the size of the document can be precisely detected.

(3) Preferably, the above construction further comprises the size changing section for setting the magnification of the document image in accordance with the operation command from the user and changing the size of the document image at the set magnification, and the recording-sheet selecting section for selecting a recording sheet having the same size as the one detected by the size detecting section as a recording sheet to have the document image printed thereon even if the size of the document image is changed by the size changing section with the document identical size mode set.

With this construction, the document image is printed on the recording sheet having the same size as the document without canceling the document identical size mode even if the magnification of the document image is changed with the document identical size mode set. Thus, the user can print the document image on the recording sheet having the same size as the document even without designating the size of the recording sheet after changing the magnification of the document image.

(4) In the above construction, the mode setting section preferably does not change the operation mode even if the size of the document image is changed by the size changing section before the size of the document is detected by the size detecting section with the document identical mode set.

With this construction, the recording-sheet selecting section selects the recording sheet having the same size as the document as a recording sheet to have the document image printed thereon even if the user sets the magnification before the size of the document is detected by the size detecting section. Thus, the user can print the document image on the recording sheet having the same size as the document without designating the size of the recording sheet after designating the magnification.

(5) In the above construction, the mode setting section preferably does not change the operation mode even if the size of the document image is changed by the size changing section after the size of the document is detected by the size detecting section with the document identical size mode set.

With this construction, even if the user sets the magnification after the size of the document is detected by the size detecting section, the recording-sheet selecting section selects a recording sheet having the same size as that of the document detected by the size detecting section as a recording sheet to have the document image printed thereon. Thus, the user can print the document image on the recording sheet having the same size as the document without designating the size of the recording sheet even if changing the magnification of the document image after the size of the document is detected.

(6) The above construction preferably further comprises the document size setting section for setting the size of the document to be read in accordance with the operation command from the user, and the recording-sheet selecting section for selecting a recording sheet having the same size as the one set by the document size setting section in place of the recording sheet having the size detected by the size detecting section as a recording sheet to have the document image printed thereon in the document identical size mode is set.

With this construction, if the user sets the size of the document, the document image is printed on the recording sheet having the same size as the set size. Thus, the user can print the document image on the recording sheet having the same size as the document without separately setting the size of the recording sheet. Further, by setting the size of the document, the document image can also be printed on a recording sheet having a desired size different from that of the document to be actually read.

(7) In the above construction, the mode setting section preferably sets the operation mode to either one of the document identical size mode and the optimal size mode in which the document image is printed on a recording sheet having a size conforming to the document image.

With this construction, the user can set the document identical size mode if he desires to print the document image on a recording sheet having the same size as the document regardless of the magnification, whereas he can set the optimal size mode if he desires to print the entire document image having the size thereof changed without leaving any part unprinted. Thus, the user can precisely understand the operation modes settable in the image forming apparatus. As a result, such an event where the document image is printed on the recording sheet having a size against the user's intension can be avoided.

(8) Preferably, the above construction further comprises the size detecting section for detecting the size of the document, and the document image is outputted on a recording sheet having the same size as that of the document detected by the size detecting section in the document identical size mode.

With this construction, the effects similar to those of (2) can be presented.

(9) Preferably, the above construction further comprises the size changing section for setting the magnification of the document image in accordance with the operation command from the user and changing the size of the document image based on the set magnification, and the recording-sheet selecting section for selecting a recording sheet having the same size as the one detected by the size detecting section as a recording sheet to have the document image printed thereon even if the size of the document image is changed by the size changing section in the case that the document identical size mode is set.

With this construction, the effects similar to those of (3) can be presented.

(10) The recording-sheet selecting section preferably selects a recording sheet having a size conforming to that of the document image as a recording sheet to have the document image printed thereon if the optimal size mode is set.

With this construction, the document image can be printed on the recording sheet having the conforming size.

(11) In the above construction, the mode setting section preferably does not change the operation mode even if the size of the document image is changed by the size changing section before the size of the document is detected by the size detecting section with the document identical size mode set.

With this construction, the effects similar to those of (4) can be presented.

(12) In the above construction, the mode setting section preferably does not change the operation mode even if the size of the document image is changed by the size changing section after the size of the document is detected by the size detecting section with the document identical size mode set.

With this construction, the effects similar to those of (5) can be presented.

(13) Preferably, the above construction further comprises the display unit for displaying the operation screen used for the user to input the operation command when the mode setting section receives the operation command from the user fro setting the operation mode.

With this construction, the user can easily input the operation command for setting the operation mode.

(14) In the above construction, the recording-sheet selecting section preferably selects a recording sheet having such a size as to eliminate a margin portion of the document image as the recording sheet having the conforming size.

With this construction, the recording sheet having such as a size that there is no margin portion and the document image is printed on the entire surface of the recording sheet can be selected as the recording sheet having the conforming size.

(15) In the above construction, the recording-sheet selecting section preferably selects a recording sheet having such a size as to minimize the area of the margin portion of the document image as a recording sheet having the conforming size.

With this construction, the recording sheet having such a size as to minimize the area of the margin portion can be selected as the recording sheet having the conforming size.

(16) Preferably in the above construction, the recording-sheet selecting section judges the presence or absence of the recording sheet having the same size as the one detected by the size detecting section, and the notifying section is further provided to notify the user of the absence of the recording sheet if the recording-sheet selecting section judges the absence of the recording sheet having the same size.

With this construction, the absence of the recording sheet is notified to the user in the case that there is no recording sheet having the same size as the recording sheet selected by the recording-sheet selecting section (in the case that the recording sheets have run out, no sheet cassette containing the recording sheet of this size is provided or other cases). Thus, the user can grasp the presence or absence of the recording sheet.

(17) In the above construction, the recording-sheet selecting section preferably selects a recording sheet having a size most approximate to the detected size as a recording sheet to have the document image printed thereon in the absence of the recording sheet having the same size as that of the document detected by the size detecting section.

With this construction, the recording sheet having the size most approximate to the size of the selected recording sheet is selected as the recording sheet to have the document image printed thereon in the absence of the recording sheet having the same size as the recording sheet selected by the recording-sheet selecting section. Thus, a possibility of printing the document image on the recording sheet having a size intended by the user can be increased even in the absence of the recording sheet selected by the recording-sheet selecting section.

(18) The above construction preferably further comprises the preview image displaying section for displaying a preview image showing a printed state of the document image having the size thereof changed by the size changing section on the recording sheet selected by the recording-sheet selecting section.

With this construction, the preview image showing the printed state of the document image having the magnification changed on the recording sheet is presented to the user before the printing. Thus, the user can confirm beforehand which part of the document image cannot be printed on the recording sheet, thereby preventing a copying error.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an image acquiring unit for reading an image of a document to thereby acquire a document image; and a mode setting section for setting an operation mode to a document identical size mode in which the document image is outputted on a recording sheet having the same size as the document regardless of a magnification set by a user.

2. An image forming apparatus according to claim 1, further comprising a size detecting section for detecting the size of the document, wherein the document image is outputted on a recording sheet having the same size as that of the document detected by the size detecting section.

3. An image forming apparatus according to claim 2, further comprising:

a size changing section for setting the magnification of the document image in accordance with an operation command from a user and changing the size of the document image based on the set magnification; and a recording-sheet selecting section for selecting a recording sheet having the same size as the one detected by the size detecting section as a recording sheet to have the document image printed thereon even if the size of the document image is changed by the size changing section with the document identical size mode set.

4. An image forming apparatus according to claim 3, wherein the mode setting section does not change the operation mode even if the size of the document image is changed by the size changing section before the size of the document is detected by the size detecting section with the document identical size mode set.

5. An image forming apparatus according to claim 3, wherein the mode setting section does not change the operation mode even if the size of the document image is changed by the size changing section after the size of the document is detected by the size detecting section with the document identical size mode set.

6. An image forming apparatus according to claim 3, further comprising:

a document size setting section for setting the size of the document to be read in accordance with an operation command from the user; and a recording-sheet selecting section for selecting a recording sheet having the same size as the one set by the document size setting section in place of the recording sheet having the size detected by the size detecting section as a recording sheet to have the document image printed thereon.

7. An image forming apparatus according to claim 3, wherein the recording-sheet selecting section judges the presence or absence of the recording sheet having the same size as the one detected by the size detecting section, and the image forming apparatus further comprises a notifying section for notifying the user of the absence of the recording sheet if the recording-sheet selecting section judges the absence of the recording sheet having the same size.

8. An image forming apparatus according to claim 3, wherein the recording-sheet selecting section selects a recording sheet having a size most approximate to the detected size as a recording sheet to have the document image printed thereon if there is no recording sheet having the same size as that of the document detected by the size detecting section.

9. An image forming apparatus according to claim 3, further comprising a preview image displaying section for displaying a preview image showing a printed state of the document image having the size thereof changed by the size changing section on the recording sheet selected by the recording-sheet selecting section before the printing.

10. An image forming apparatus according to claim 1, wherein the mode setting section sets the operation mode to either one of the document identical size mode and an optimal size mode in which the document image is printed on a recording sheet having a size conforming to the document image.

11. An image forming apparatus according to claim 10, further comprising a size detecting section for detecting the size of the document, wherein the document image is outputted on a recording sheet having the same size as that of the document detected by the size detecting section in the document identical size mode.

12. An image forming apparatus according to claim 11, further comprising;

a size changing section for setting the magnification of the document image in accordance with an operation command from a user and changing the size of the document image based on the set magnification; and a recording-sheet selecting section for selecting a recording sheet having the same size as the one detected by the size detecting section as a recording sheet to have the document image printed thereon even if the size of the document image is changed by the size changing section with the document identical size mode set.

13. An image forming apparatus according to claim 12, wherein the recording-sheet selecting section selects a recording sheet having a size conforming to that of the document image as a recording sheet to have the document image printed thereon if the optimal size mode is set.

14. An image forming apparatus according to claim 13, wherein the recording-sheet selecting sections selects a recording sheet having such a size as to eliminate a margin portion of the document image as a recording sheet having the conforming size.

15. An image forming apparatus according to claim 13, wherein the recording-sheet selecting sections selects a recording sheet having such a size as to minimize a margin portion of the document image as a recording sheet having the conforming size.

16. An image forming apparatus according to claim 12, wherein the mode setting section does not change the operation mode even if the size of the document image is changed by the size changing section before the size of the document is detected by the size detecting section with the document identical size mode set.

17. An image forming apparatus according to claim 12, wherein the mode setting section does not change the operation mode even if the size of the document image is changed by the size changing section after the size of the document is detected by the size detecting section with the document identical size mode set.

18. An image forming apparatus according to claim 1, further comprising a display unit for displaying an operation screen used for a user to input an operation command when the mode setting section receives the operation command from the user for setting the operation mode.

* * * * *

UNITED STATES PATENT AND TRADEMARK OFFICE

CERTIFICATE OF CORRECTION

PATENT NO. : 7,280,782 B2
APPLICATION NO. : 11/191288
DATED : October 9, 2007
INVENTOR(S) : Tetsuya Maeda et al.

It is certified that error appears in the above-identified patent and that said Letters Patent is hereby corrected as shown below:

Title Page, Item (54) Title, should read:

(54) IMAGE FORMING APPARATUS WITH A DCOUMENT IDENTICAL SIZE MODE FOR OUTPUTTING A DOCUMENT IMAGE HAVING A SIZE CONFORMING TO THE DOCUMENT

Signed and Sealed this

Eighteenth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,280,782 B2
APPLICATION NO. : 11/191288
DATED : October 9, 2007
INVENTOR(S) : Tetsuya Maeda et al.

It is certified that error appears in the above-identified patent and that said Letters Patent is hereby corrected as shown below:

Title Page, Item (54) Title and Column 1, lines 1-5, should read:

(54) IMAGE FORMING APPARATUS WITH A DOCUMENT IDENTICAL SIZE MODE FOR OUTPUTTING A DOCUMENT IMAGE HAVING A SIZE CONFORMING TO THE DOCUMENT

This certificate supersedes the Certificate of Correction issued December 18, 2007.

Signed and Sealed this

Nineteenth Day of February, 2008

JON W. DUDAS
*Director of the United States Patent and Trademark Office*